US005424170A

United States Patent [19]

Sudo et al.

[11] Patent Number: 5,424,170

[45] Date of Patent: Jun. 13, 1995

[54] SILVER HALIDE PHOTOGRAPHIC LIGHT SENSITIVE MATERIAL

[75] Inventors: Susumu Sudo; Yasushi Usagawa, both of Hino, Japan

[73] Assignee: Konica Corporation, Tokyo, Japan

[21] Appl. No.: 296,143

[22] Filed: Aug. 26, 1994

[30] Foreign Application Priority Data

Aug. 31, 1993 [JP] Japan ..... 5-216492

[51] Int. Cl.[6] ..... G03C 1/06

[52] U.S. Cl. ..... 430/264; 430/598

[58] Field of Search ..... 430/264, 598

[56] References Cited

U.S. PATENT DOCUMENTS 2,064,700 12/1936 Stein .
2,456,957 12/1948 Koch et al. .
2,497,875 2/1950 Fallesen .
2,563,758 8/1951 Tinling .
2,588,982 3/1952 Ives .
2,592,250 4/1952 Davey et al. .
3,206,316 9/1965 Klaui .
3,271,157 9/1966 McBride .
3,317,322 5/1967 Porter et al. .
3,367,778 2/1968 Berriman .
3,447,927 6/1969 Bacon et al. .
3,496,577 2/1970 Saldana .
3,531,291 9/1970 Bacon .
3,761,266 9/1973 Milton .
4,686,167 8/1987 Resnick et al. .
4,988,504 1/1991 Zotto et al. .
4,988,604 1/1991 Machonkin et al. .
5,030,547 7/1991 Katoh .
5,041,355 8/1991 Machonkin et al. .
5,254,436 10/1993 Koga et al. ..... 430/264

FOREIGN PATENT DOCUMENTS

0331096A3 9/1989 European Pat. Off. .
0446078A1 9/1991 European Pat. Off. .

*Primary Examiner*—Thorl Chea
*Attorney, Agent, or Firm*—Finnegan, Henderson, Farabow, Garrett & Dunner

[57] ABSTRACT

A silver halide photographic light sensitive material contains a novel nucleating compound represented by the following formula (I), which is capable of functioning as a contrast increasing agent in a negative system or as a foggant in a direct positive system Formula (I)

8 Claims, No Drawings

SILVER HALIDE PHOTOGRAPHIC LIGHT SENSITIVE MATERIAL

FIELD OF THE INVENTION

This invention relates to a silver halide photographic light sensitive material, particularly to a novel silver halide photographic light sensitive material containing a compound capable of functioning as a noble nucleating agent.

BACKGROUND OF THE INVENTION

In a photomechanical process where a continuous tone densities of an original are converted respectively into the group consisting of the halftone dots having the areas proportional to the density, a silver halide photographic light sensitive material (hereinafter referred simply to a light sensitive material) having a high contrast photographic characteristic is generally used.

For providing a high contrast characteristic to an image, a desired photographic light sensitive material has been prepared in such a manner as described in Japanese Patent Publication Open to Public Inspection (hereinafter referred to as JP OPI Publication) No. 56-106244/1981, U.S. Pat. No. 4,686,167 and European Patent No. 333,435; in which a compound such as hydrazine is contained as a nucleating agent into a silver halide photographic light sensitive material and silver halide grains capable of effectively displaying contrast-increasing characteristic of the compound are further used or other photographic additives are suitably used in combination. The silver halide photographic light sensitive materials such as those mentioned above are apparently proved to be stable as a light sensitive material and a high contrast photographic image can be obtained even when they are processed with a rapid processable developer.

However, if these photographic materials are used in the step of converting a continuous tone image to a halftone image, sandlike fog or black dot which is generally referred to pepper fog can occur in halftone dots, leading to impaired dot quality, particularly when enlarging a screen image. These are remarkable particularly after raw stock keeping. In an attempt at solving this problem, various stabilizers ot restrainers having hetero atom(s) have been added but this has not always proved to be a complete solution. Under these circumstances, a light sensitive material that uses an effective contrast increasing agent free from that problem is desired.

On the other hand, as one of the methods for forming a positive image with the use of a direct positive type silver halide photographic light sensitive material, there has been known a method for forming a positive image in which an unfogged internal latent image silver halide emulsion is used and, after imagewise exposed to light, is surface-developed in the presence of a foggant to form a positive image.

In the above-mentioned technical field, various techniques have been known so far. For example, these techniques include, typically, those described in U.S. Pat. Nos. 2,592,250, 2,456,957, 2,497,875 and 2,588,982, British Patent No. 1,151,363, JP Examined Publication No. 43-29405/1968, JP OPI Publication Nos. 47-9434/1972, 47-9677/1972, 47-32813/1972, 47-32814/1972, 48-9727/1973 and 48-9717/1973, U.S. Pat. Nos. 3,761,266 and 3,496,577 and JP OPI Publication Nos. 50-8524/1975 and 50-38525/1975.

Hydrazine compounds have been known so far as useful foggants. For example, the foggants applicable thereto include hydrazine compounds given in U.S. Pat. Nos. 2,563,758 and 2,588,982, naphthyl hydrazine sulfonic acid given in U.S. Pat. No. 2,064,700, and sulfomethyl hydrazines given in British Patent No. 1,403,018. Further, JP Examined Publication No. 41-17184/1966 describes that a color positive image is obtained by making use of a hydrazide or hydrazone compound.

However, when making use of the above-given compounds, the induction period before starting a development is rather longer than that in the development of an ordinary latent image. Therefore, the development turns out to be considerably delayed.

When the conventional techniques are applied to a multilayered color photographic light sensitive material, these techniques have had such a problem that the characteristics are liable to cause an ununiformity between the layers and the resulting maximum density becomes lower.

For obtaining an excellent result while keeping a desirable fogging function, a development has been carried out at a high pH of not lower than 12. However, this type of developments have not desirable at all, because the deterioration of a developing agent is seriously accelerated and the physical property of a layer of a photographic light sensitive material is deteriorated.

Further, it has not been desirable as for the storage stability of raw stock. Therefore, as for the direct-positive type silver halide photographic light sensitive materials, it has been demanded to provide a light sensitive material containing an advantageous foggant improved in the above-mentioned problems.

SUMMARY OF THE INVENTION

It is an object of the invention to provide a silver halide photographic light sensitive material that not only has contrast photographic characteristics but also is capable of exhibiting high contrast photographic characteristics by restraining the fog that would otherwise occur in a halftone image and obtaining an excellent halftone image when enlarging a screen image, even after aging storage.

Another object of the invention is to provide a light sensitive material which, when used as a direct positive silver halide photographic material, is capable of achieving a sufficiently high maximum density (Dmax) by developing with a low-pH developer, that provide a satisfactory image of high maximum density and low minimum density by short-time fogging development, and that will experience only a small increase in minimum density even if it is stored for a while before exposure.

The above-mentioned objects of the invention can be achieved with a silver halide photographic light sensitive material having at least one silver halide emulsion layer, wherein a compound represented by the following Formula [I] is contained.

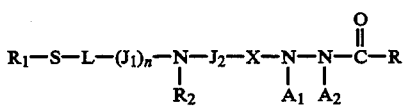

Formula (I)

wherein $R_1$ represents an alkyl group, an alkenyl group, an alkynyl group, an aryl group or a heterocyclic group; $R_2$ represents a hydrogen atom, an alkyl group, an aryl group or a heterocyclic ring group; R represents a hydrogen atom or a blocking group; L represents an alkylene group or an alkenylene group, provided that at least two rings are contained in $R_1$—S—L group and the rings may be bonded with each other directly and/or through an aliphatic linkage group; $J_1$ and $J_2$ each represent a linkage group; n is 0 or 1; X represents an aromatic or heterocyclic residue; $A_1$ and $A_2$ are each a hydrogen atom, or one of them is a hydrogen atom and the other one is an acyl, sulfonyl or oxalyl group.

DETAILED DESCRIPTION OF THE INVENTION

Now, the compounds represented by Formula (I) will be further detailed.

$R_1$ represents an alkyl group (for example, methyl, ethyl, i-propyl, butyl, t-butylhexyl, octyl, t-octyl, decyl, dodecyl, tetradecyl, cyclohexyl, cyclohexylmethyl or benzyl) an alkenyl group (e.g., ally, 1-propenyl, 1,3-butadienyl, 2-butenyl, 2-pentenyl or cinnamyl),an alkynyl group (e.g., propargyl group or 2-butynyl group) an aryl group (e.g., phenyl, tolyl, di-i-propylphenyl or a naphthyl), or a heterocyclic group (e.g., pyridyl, furyl, tetrahydrofuryl, thienyl, oxazolyl, benzooxazolyl or benzothiazolyl) and these groups may be substituted by a substituent such as an alkyl group, an aryl group, a heterocyclic group, an alkoxy group, an aryloxy group, hydroxy, a halogen atom, amino, an alkylamino group, an arylamino group, an acylamino group, an sulfonamide group or an ureido group.

L represents an alkylene group (e.g., methylene, ethylene, trimethylene, methylmethylene, ethylmethylene,butylmethylene, hexamethylene or decylmethlene) or an alkenylene (e.g., propynylene or butenylene). These group may be substituted by a substituent such as an alkyl, aryl or heterocyclic group.

A $R_1$—S—L group contains at least two ring groups. The ring group is an aromatic carbocyclic group (e.g., phenyl or naphthyl), a heterocyclic group (e.g., piperazinyl, pyrazinyl, furyl, thienyl, pyrrolyl, oxazolyl, thiazolyl or indolyl) or an alicyclic group (e.g., cyclohexyl or cyclopropyl). The cyclic groups may be bonded with each other through a bond and/or an aliphatic linkage group.

$R_2$ represents a hydrogen atom, an alkyl group (e.g., methyl, ethyl, methoxyethyl, or benzyl), an aryl group (e.g., phenyl, naphthyl, or methoxynaphthyl) or a heterocyclic group (e.g., pyridyl, thienyl, furyl, or tetrahydrofuryl).

R represents a hydrogen atom or a blocking group. The blocking group preferably includes an alkyl group (e.g., methyl, ethyl, methoxyethyl, trifluoromethyl, phenoxymethyl, hydroxymethyl, methylthiomethyl, or phenylthiomethyl), an aryl group (e.g., phenyl, chlorophenyl, or 2-hydroxymethylphenyl), a heterocyclic group (e.g., pyridyl, thienyl or furyl), —CON($R_3$)($R_4$), or —COO$R_5$. $R_3$ and $R_4$ each represent a hydrogen atom, an alkyl group (e.g., methyl, ethyl, or benzyl), an alkenyl group (e.g., allyl or butenyl), an alkynyl group (e.g., propargyl or butynyl), an aryl group (e.g., phenyl or naphthyl), a heterocyclic group (e.g., 2,2,6,6-tetramethylpiperidynyl, N-ethyl-N'-ethylpyrazorydinyl, or pyridyl), hydroxy, an alkoxy group (e.g., methoxy or ethoxy) or an amino group (e.g., amino or methylamino). $R_3$ and $R_4$ may be combined with a nitrogen atom to form a ring. $R_5$ represents a hydrogen atom, an alkyl group (e.g., methyl, ethyl, or hydroxyethyl), an alkenyl group (e.g., allyl or butenyl), an alkynyl group (e.g., propargyl or butynyl), an aryl group (e.g., phenyl or naphthyl), or a heterocyclic group (e.g., 2,2,6,6-tetramethylpiperidinyl, N-methylpiperidinyl, or pyridyl).

$J_1$ and $J_2$ each represent a linkage group. Thus, $J_1$ is —CO—, —$SO_2$—, —N($A^3$)CO—, —N($A_3$)N($A_4$)CO—, or —CON($A_3$)N($A_4$)CO—, in which $A_3$ and $A_4$ each represent a hydrogen atom, an alkyl group, an aryl group, or a heterocyclic group. $J_1$ is preferably —CO— when n is 1.

$J_2$ represents an acylamino group (e.g., benzoyl or phenoxyacetyl), a sulfonamide (e.g., benzenesulfonamide or furansulfonamide) an ureido group (e.g., ureido or phenylureido), an alkylamino (e.g. benzylamino or furfurylamino), an anilino group, an alkylideneamino (e.g., benzylideneamino), an aryloxy group (e.g., phenoxy), an aminocarbonylalkoxy group (e.g., aminocarbonylmethoxy), or an sulfonylhydrazinocarbonylamino group (e.g., benzenesulfonylhydrazinocarbonylamino). $J_2$ is preferably a benzenesulfonamide group.

X represents an arylene group (e.g., phenylene or naphthylene, including a substituted one thereof) or a bivalent heterocyclic group (e.g., a bivalent residue of pyridine, pyrazole, pyrrole, thiophene, benzothiophene, or furan).

$A_1$ and $A_2$ represent each a hydrogen atom, or one of them is a hydrogen atom and the other one is a group selected from an acyl group (e.g., acetyl or trifluoroacetyl), a sulfonyl group (e.g., methanesulfonyl or toluenesulfonyl) and an oxalyl group (e.g., ethoxyoxalyl).

Typical compounds of the invention represented by Formula (I) will be given below. It is, however, to be understood that the invention shall not be limited thereto.

I-1

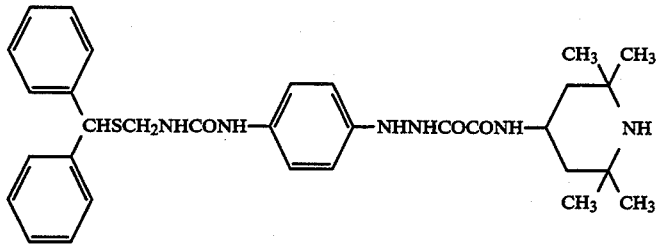

-continued
I-2
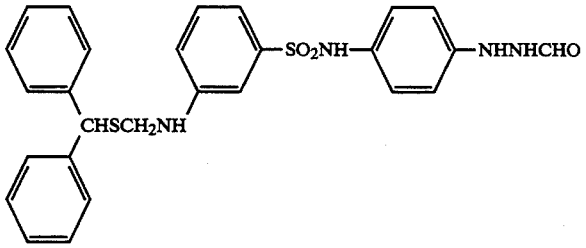
I-3
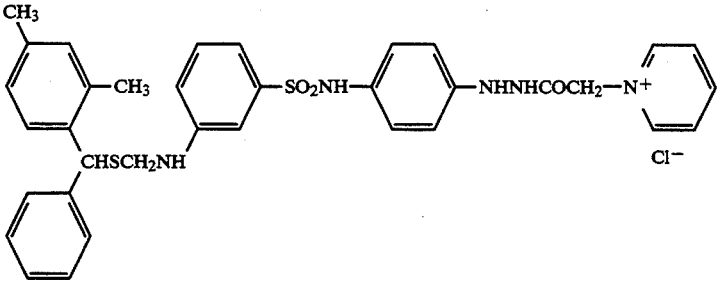
I-4
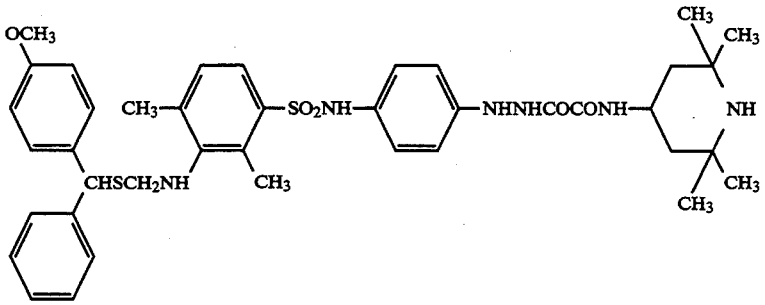
I-5
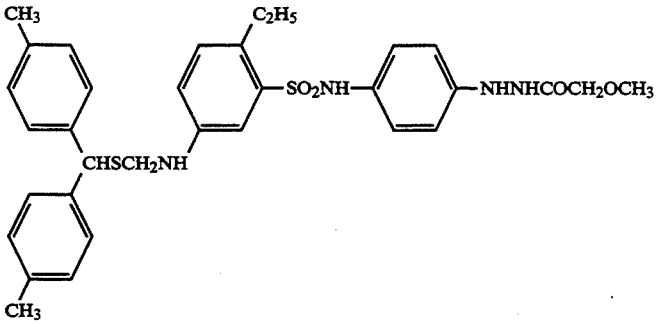
I-6
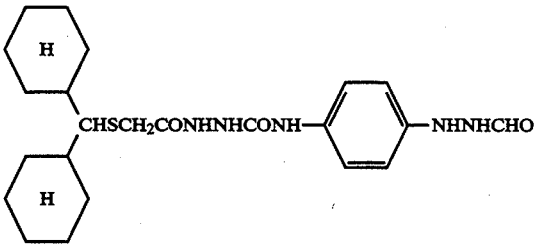

-continued
I-7
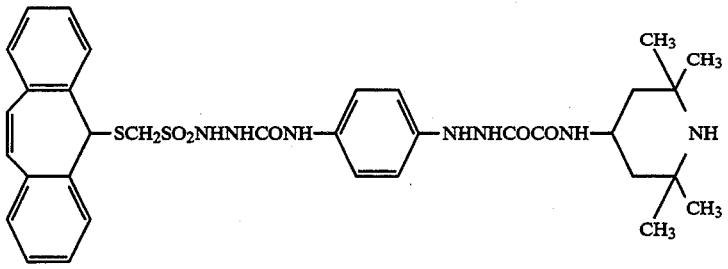
I-8
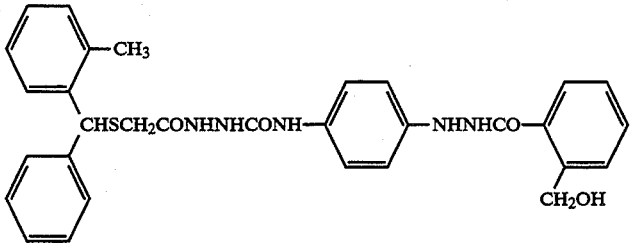
I-9
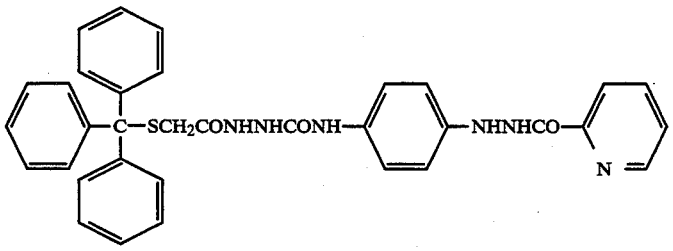
I-10
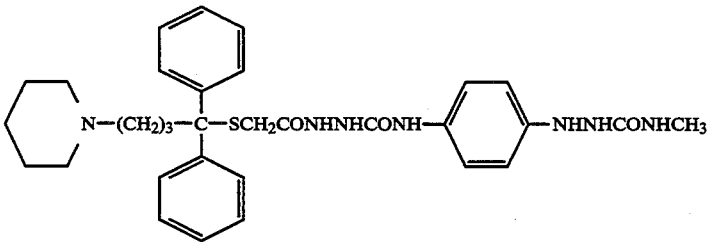
I-11
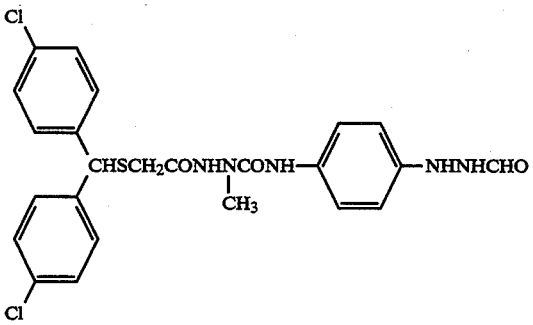

-continued
I-12
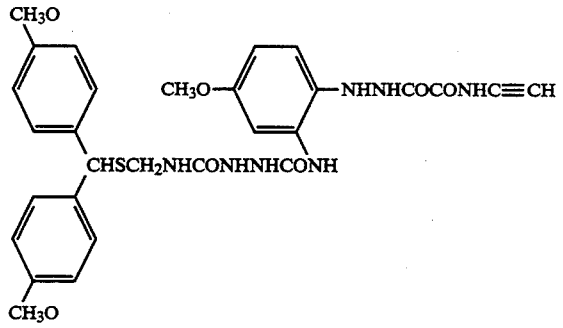
I-13
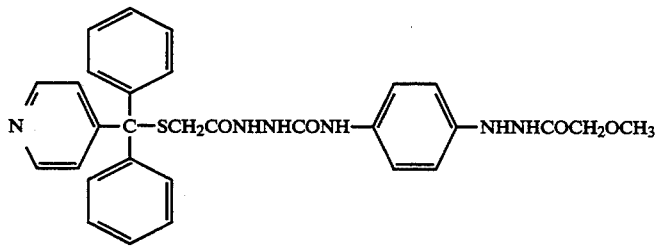
I-14
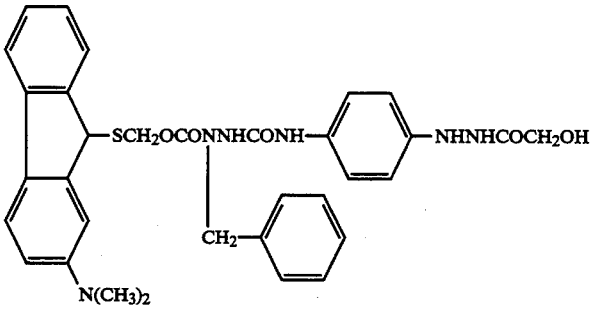
I-15
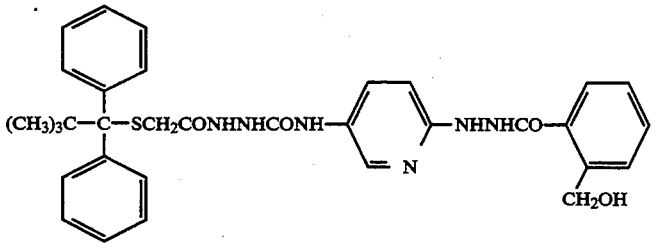
I-16
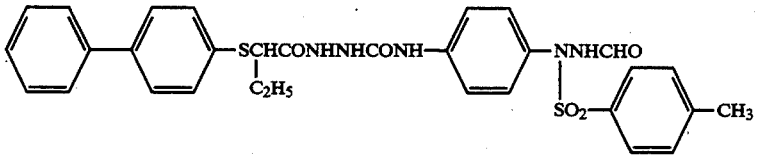
I-17
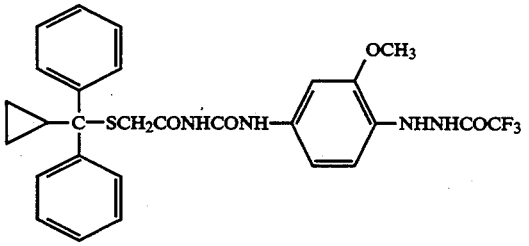

-continued
I-18
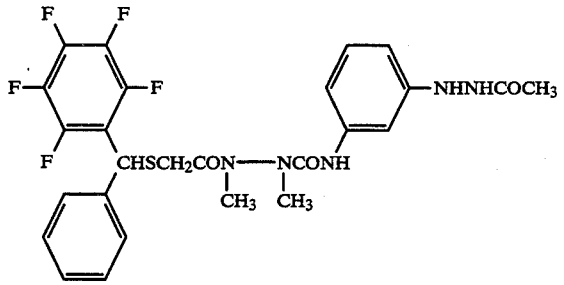
I-19
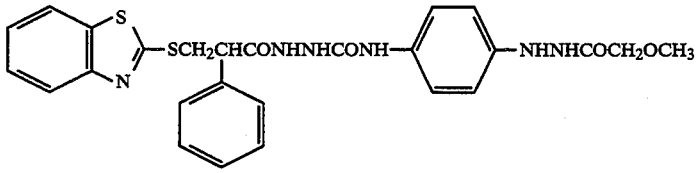
I-20
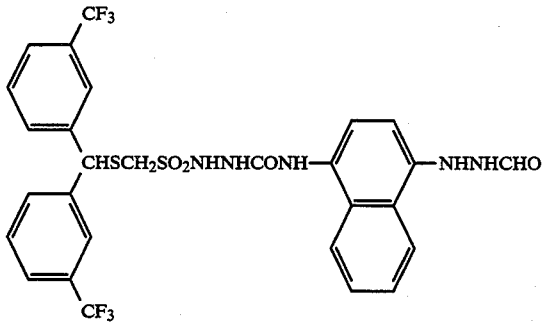
I-21
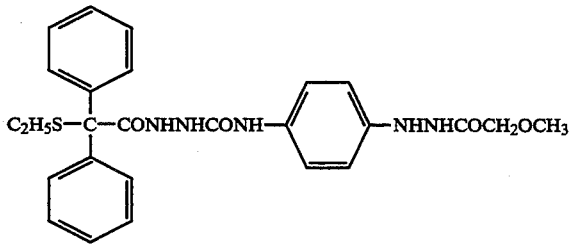
I-22
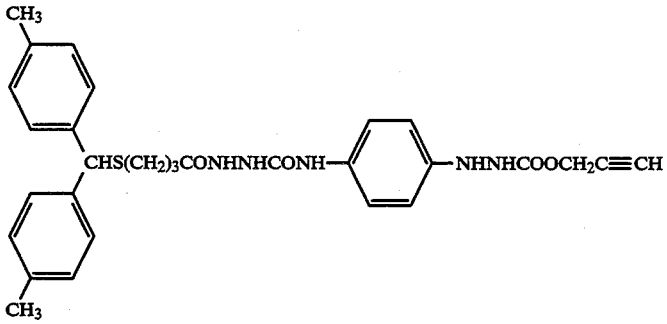
I-23
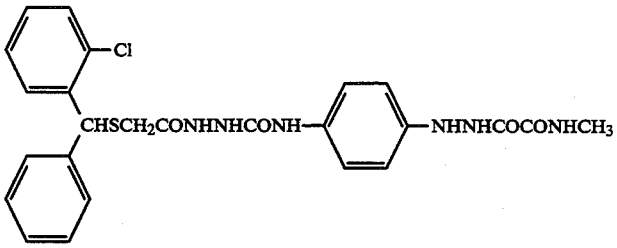

-continued
I-24
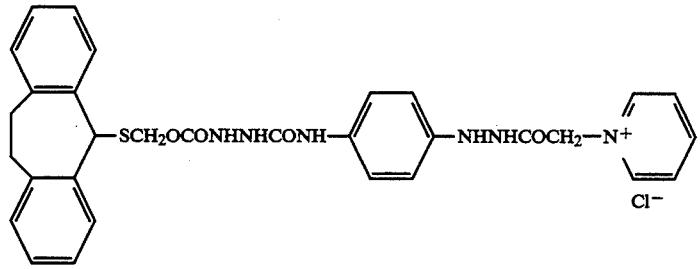
I-25
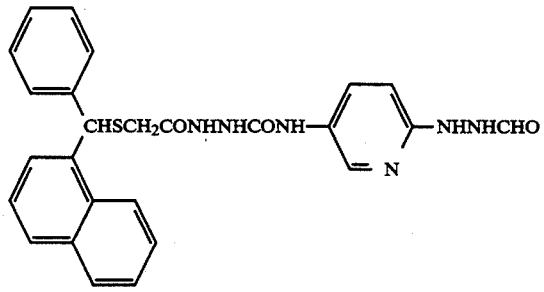
I-26
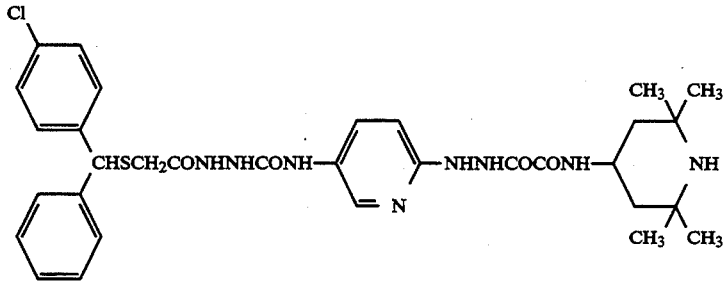
I-27
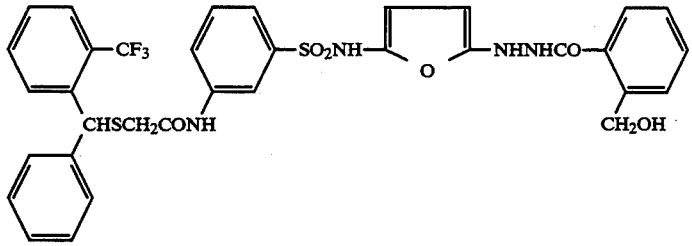
I-28
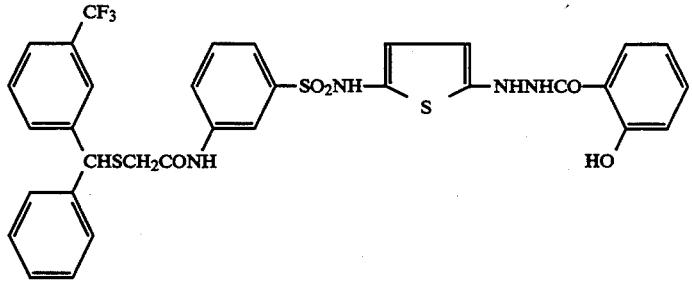

-continued
I-29
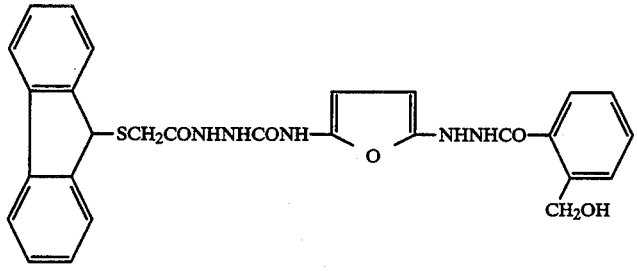
I-30
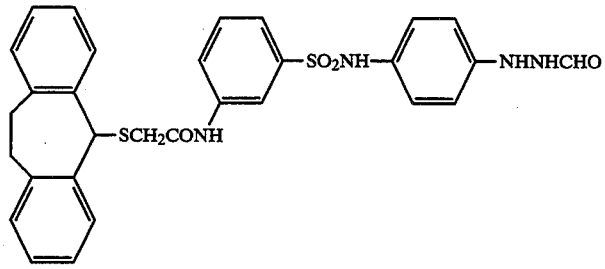
I-31
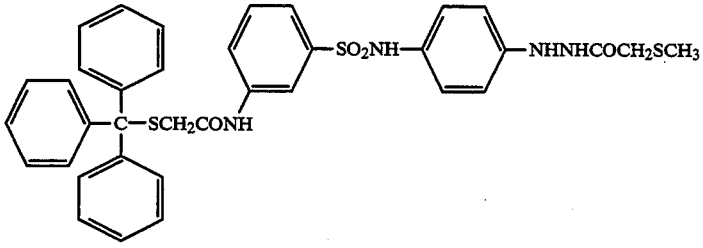
I-32
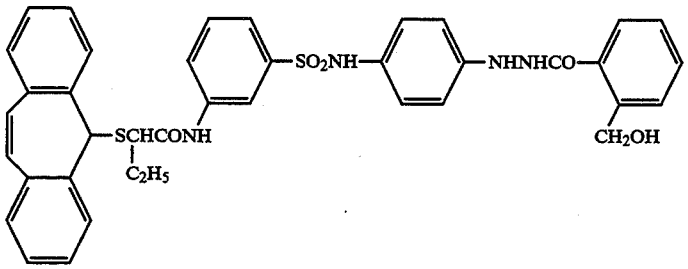
I-33
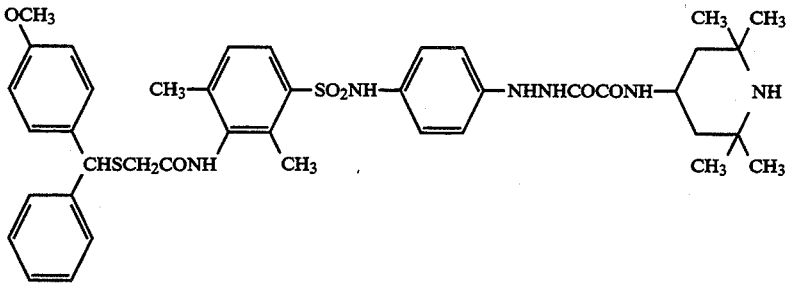

-continued
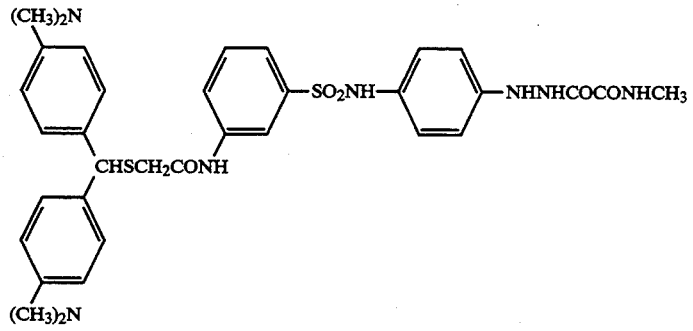
I-34
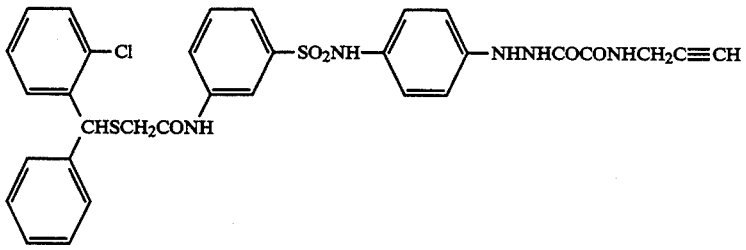
I-35
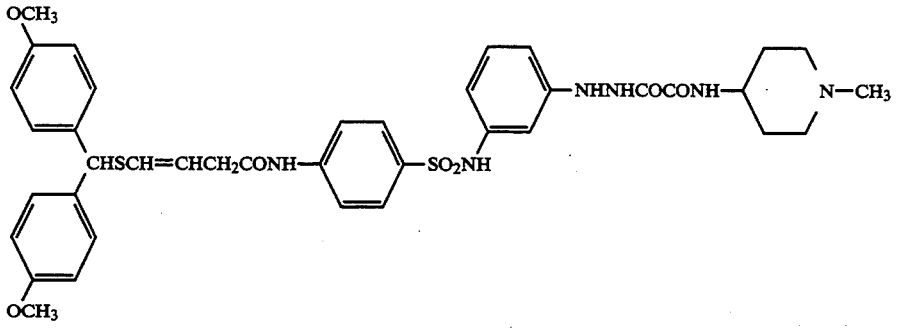
I-36
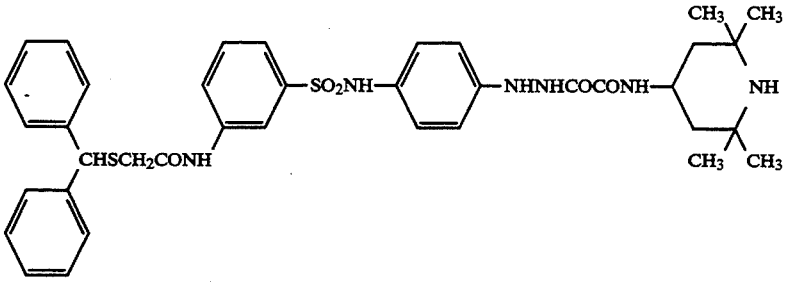
I-37
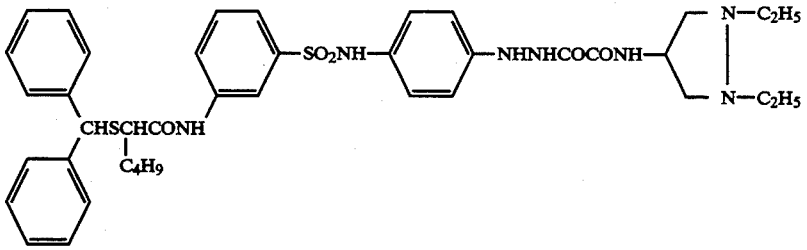
I-38

-continued
I-39
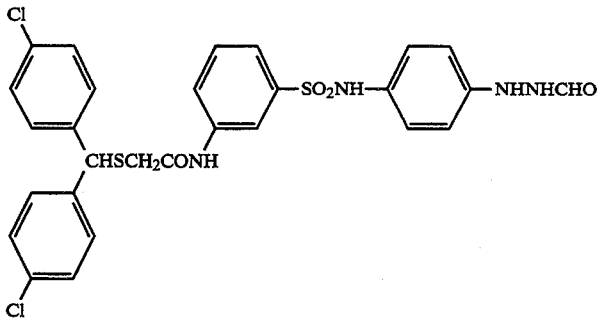
I-40
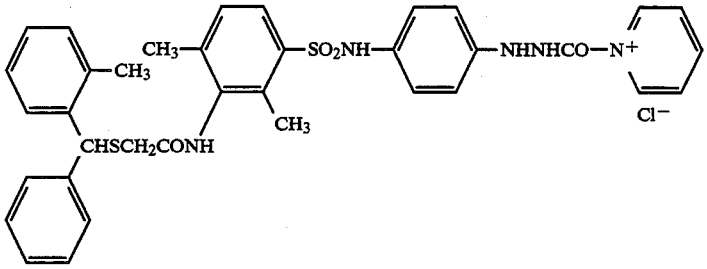
I-41
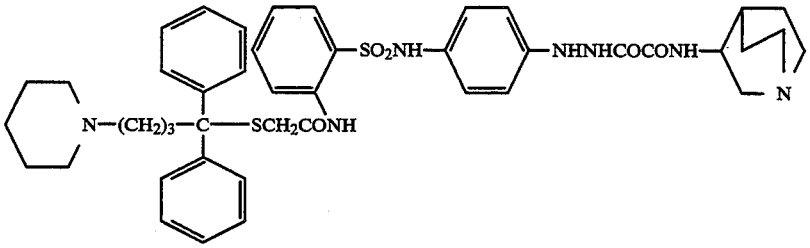
I-42
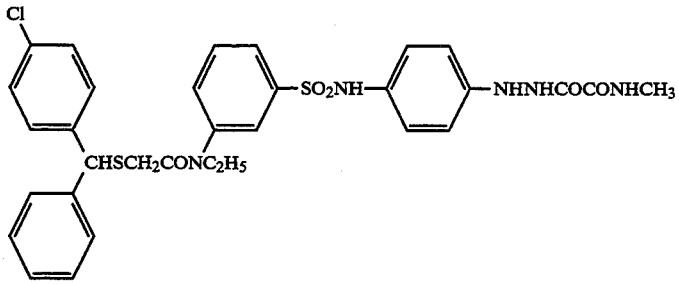
I-43
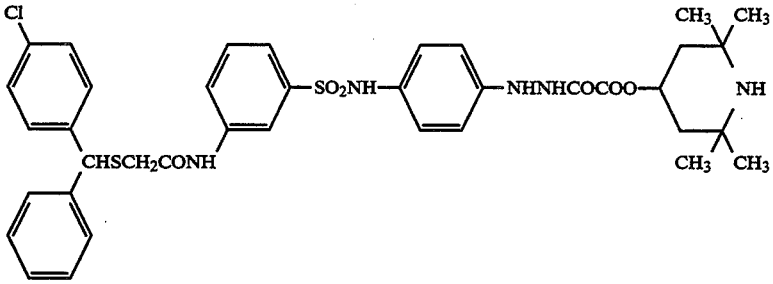

-continued
I-44
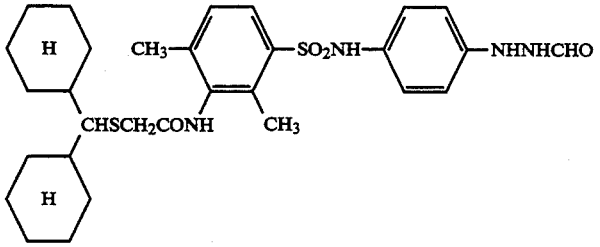
I-45
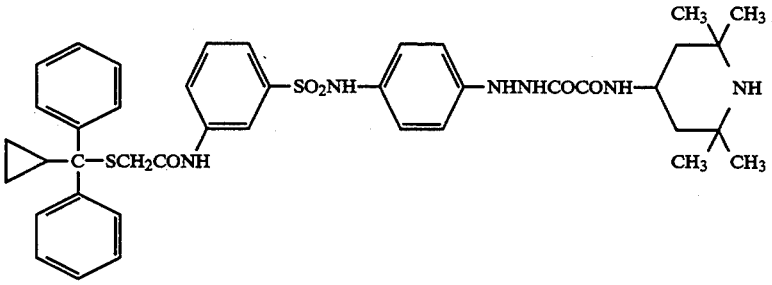
I-46
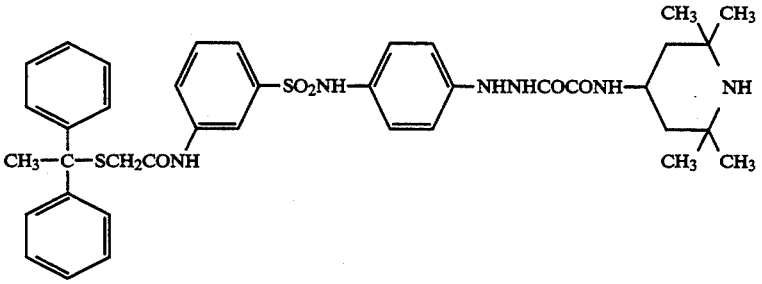
I-47
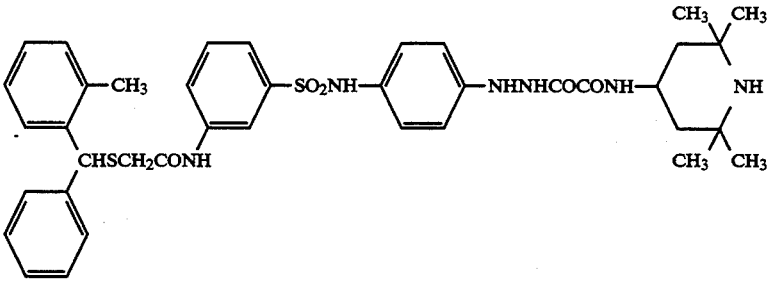
I-48
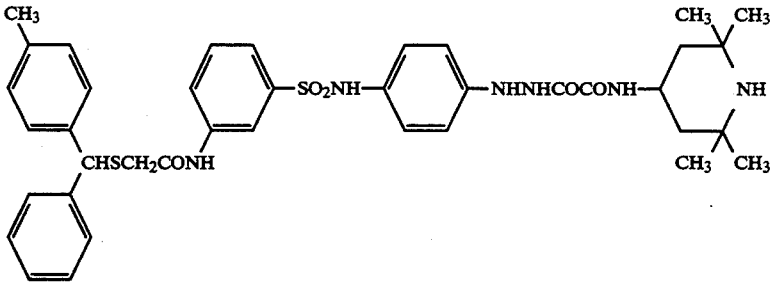

-continued
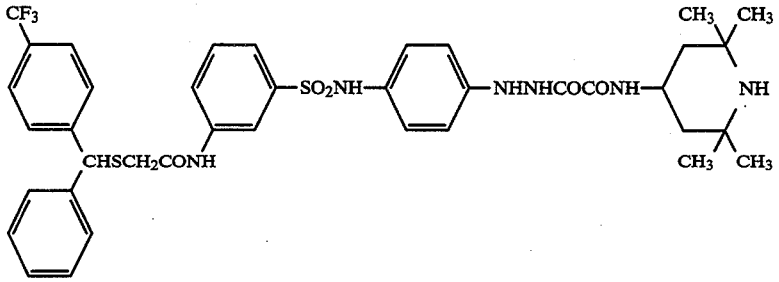
I-49
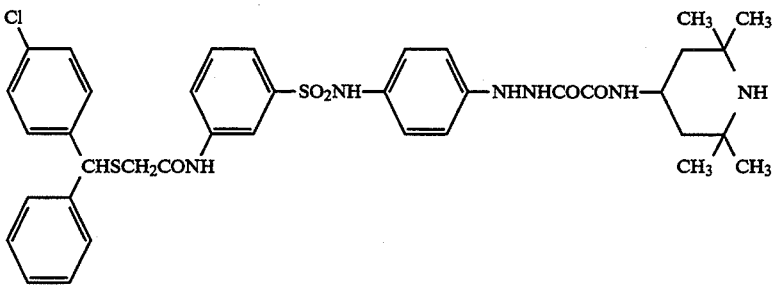
I-50
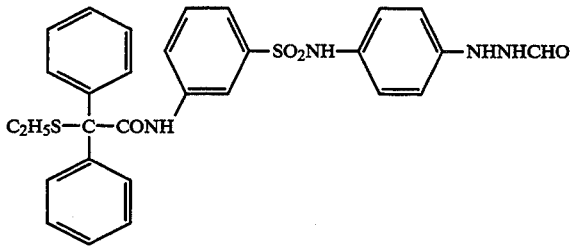
I-51
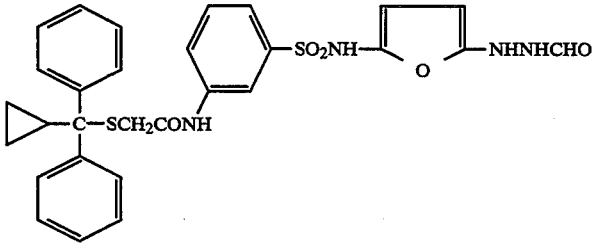
I-52
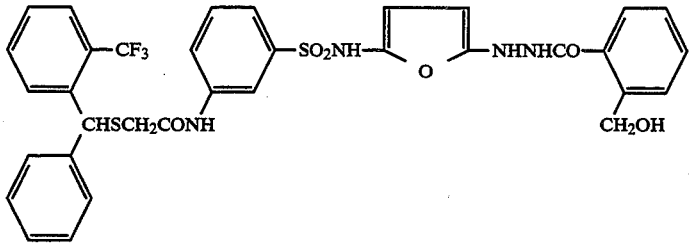
I-53
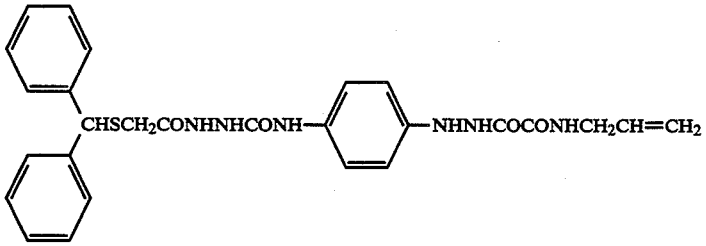
I-54

-continued
I-55
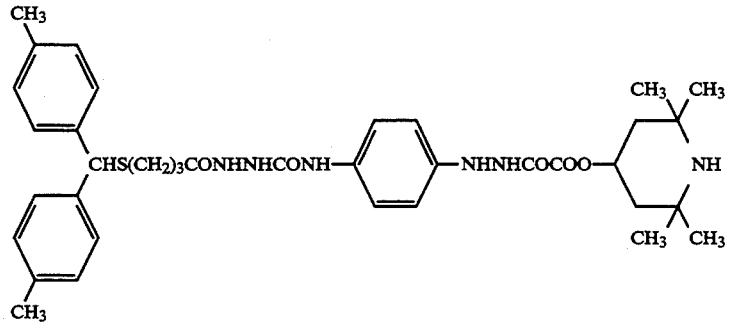
I-56
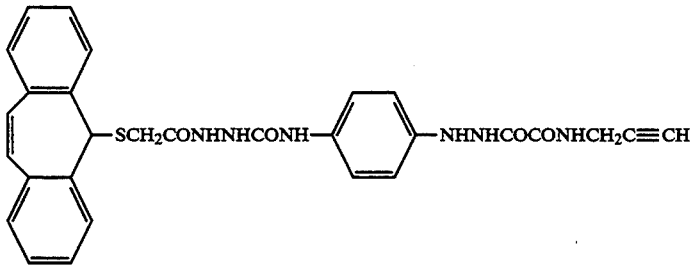
I-57
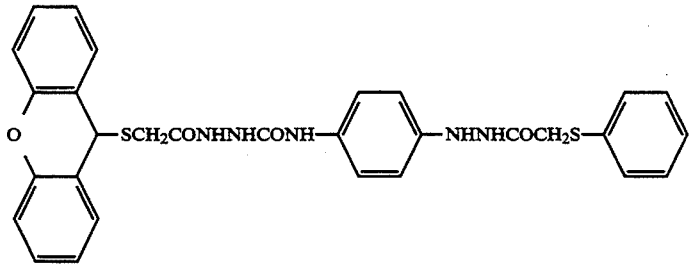
I-58
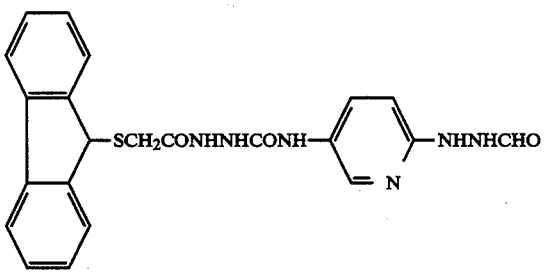
I-59
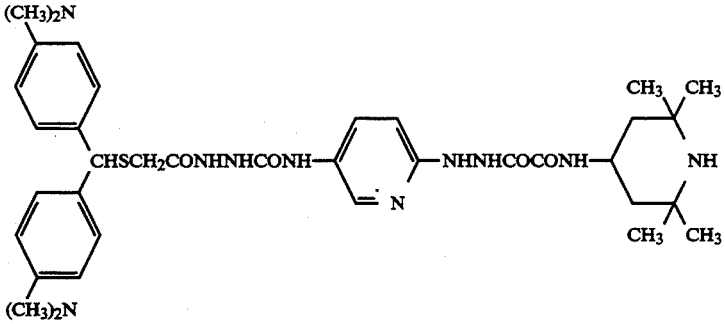

-continued
I-60
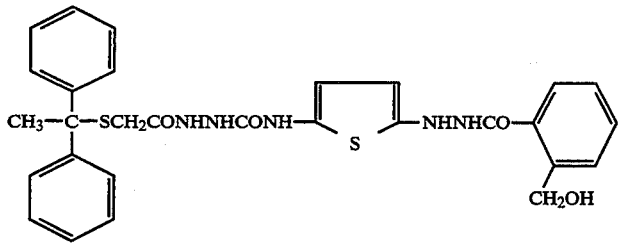
I-61
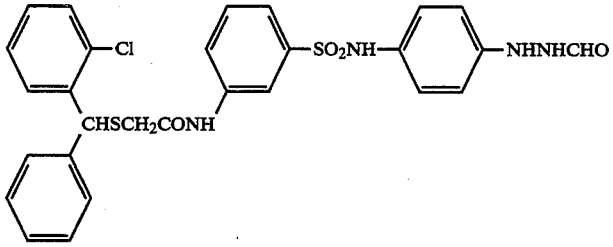
I-62
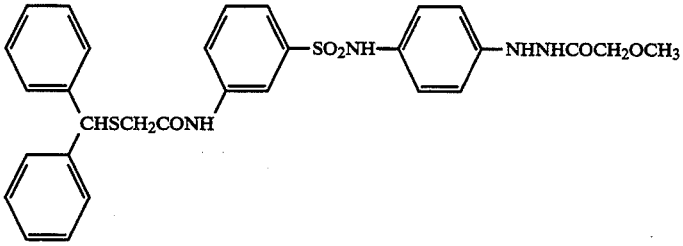
I-63
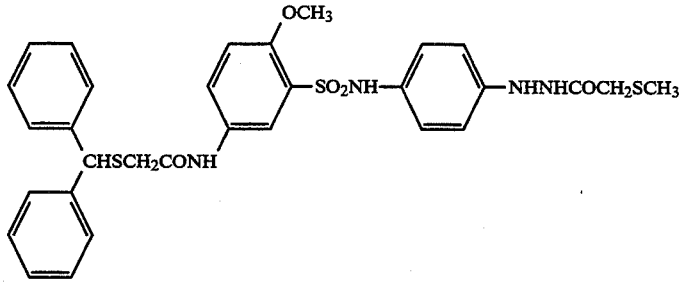
I-64
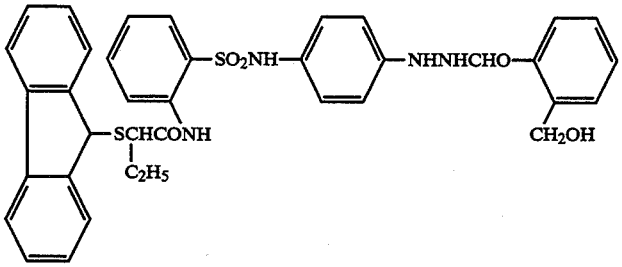
I-65
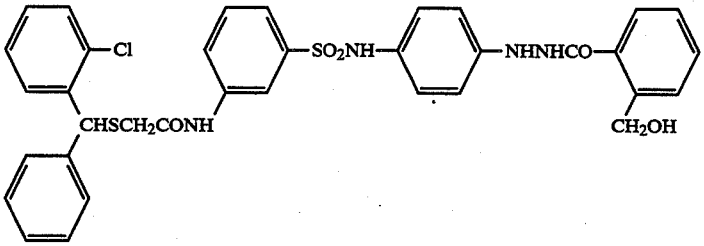

-continued
I-66
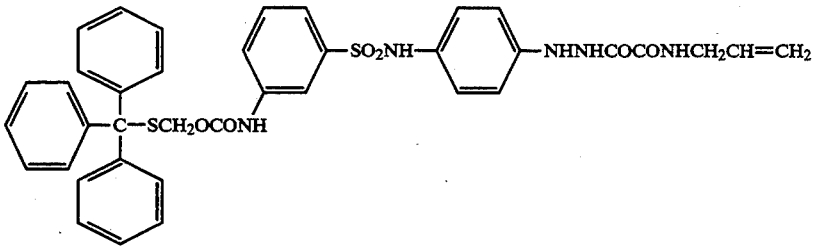
I-67
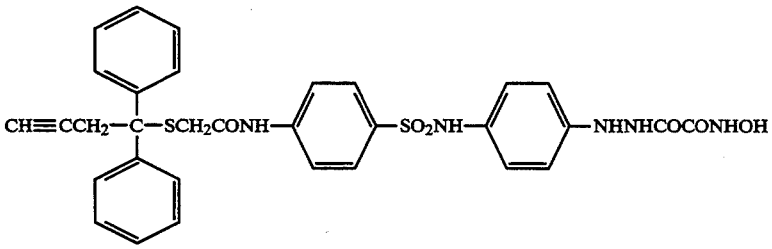
I-68
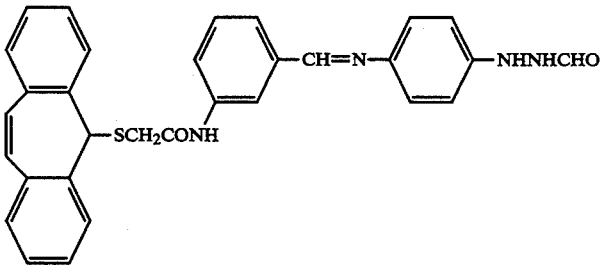
I-69
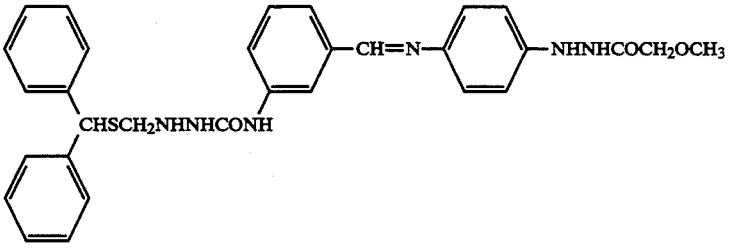
I-70
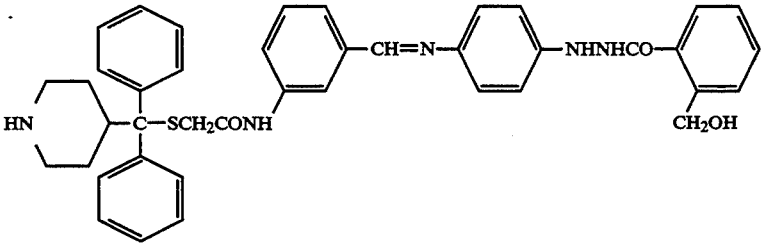
I-71
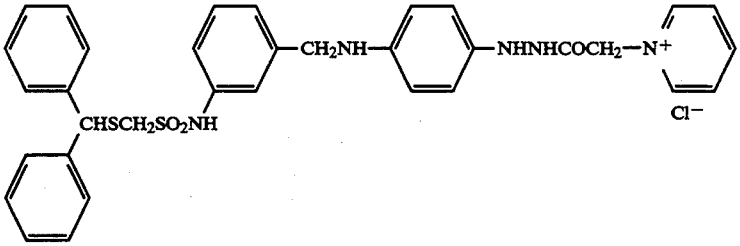

-continued
I-72
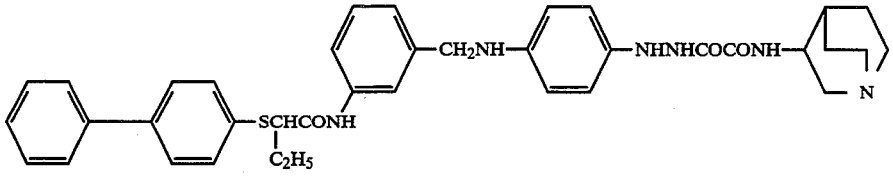
I-73
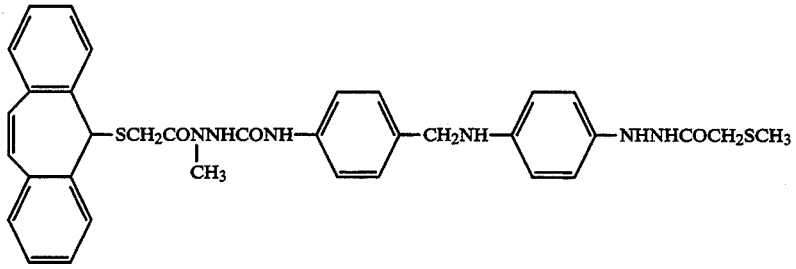
I-74
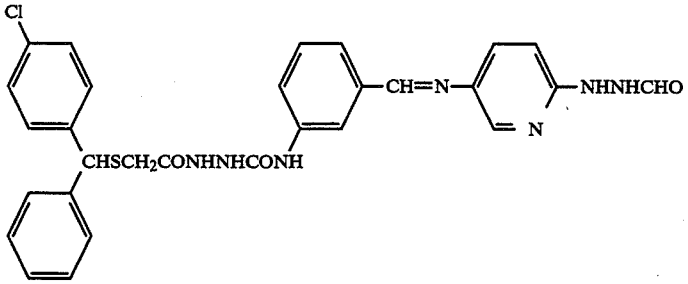
I-75
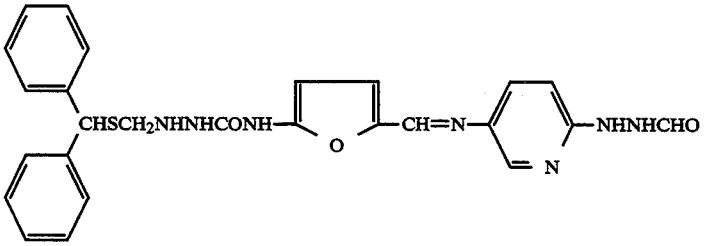
I-76
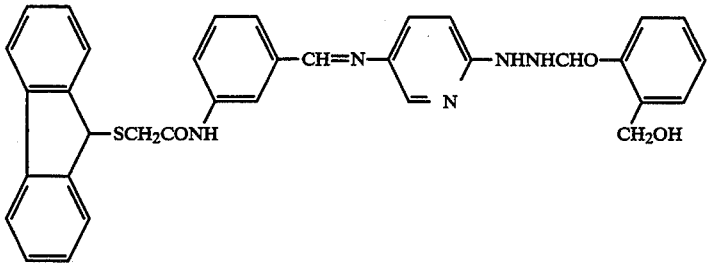
I-77
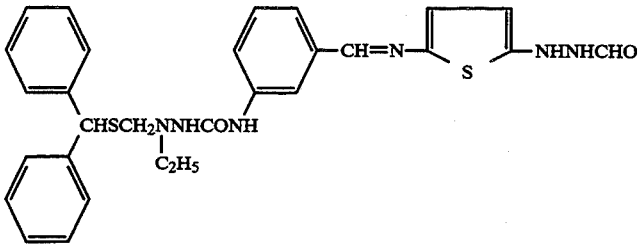

-continued
I-78
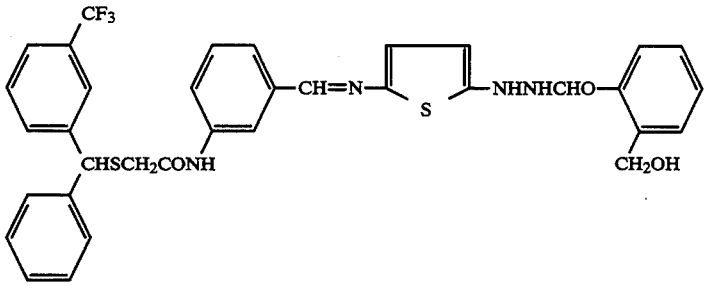
I-79
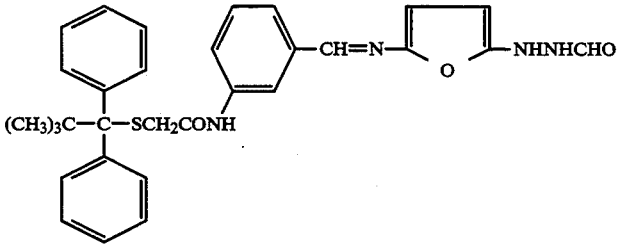
I-80
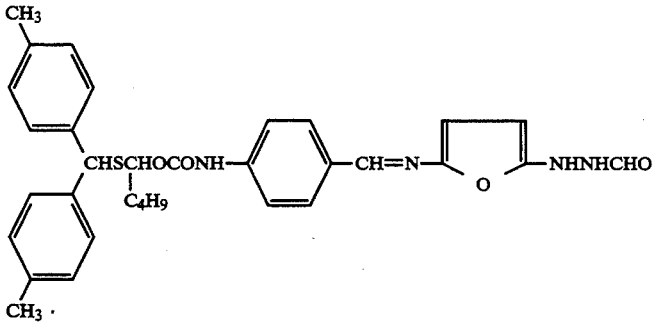
I-81
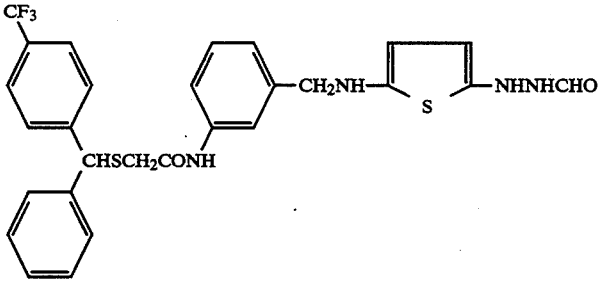
I-82
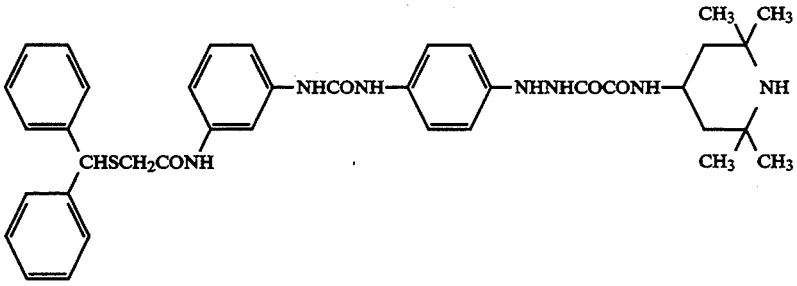

-continued
I-83
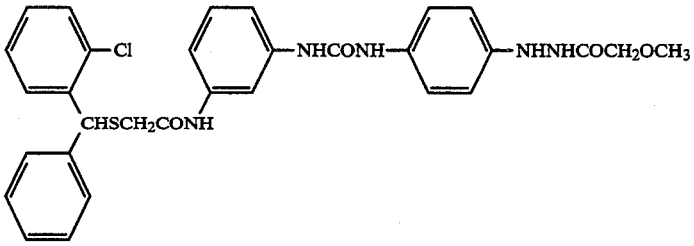
I-84
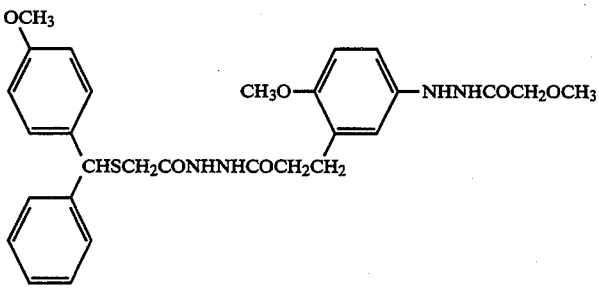
I-85
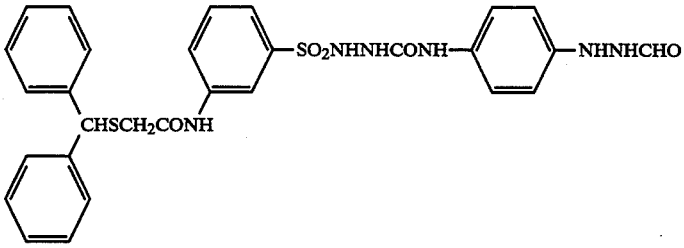
I-86
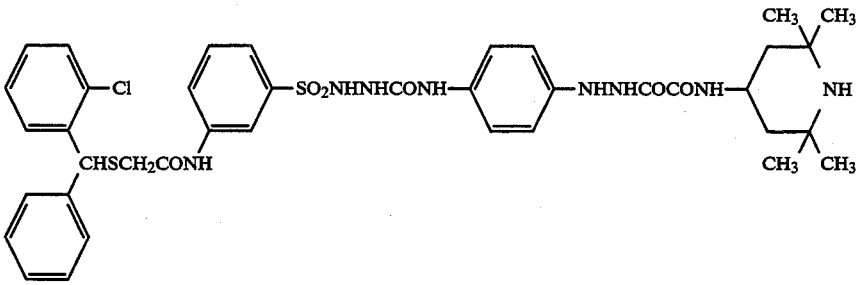
I-87
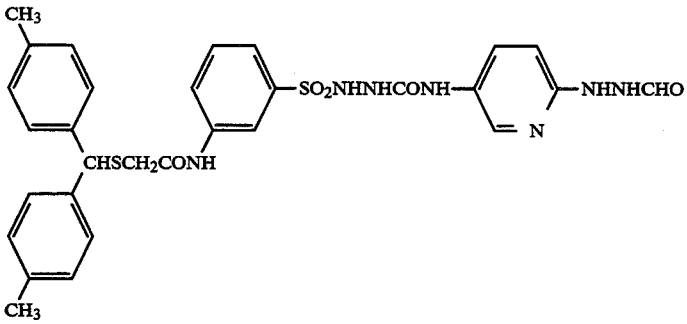
I-88
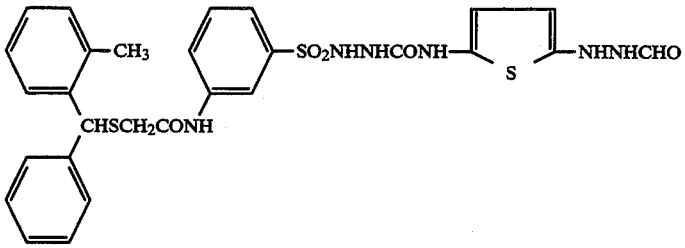

-continued
I-89
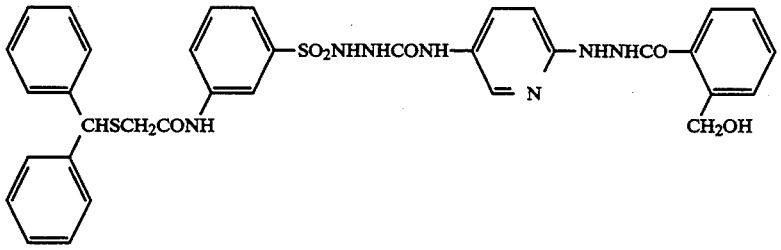
I-90
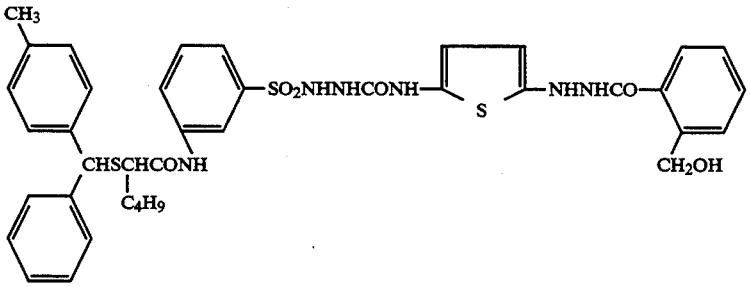
I-91
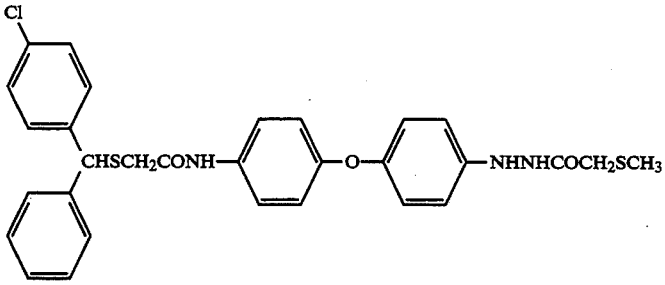
I-92
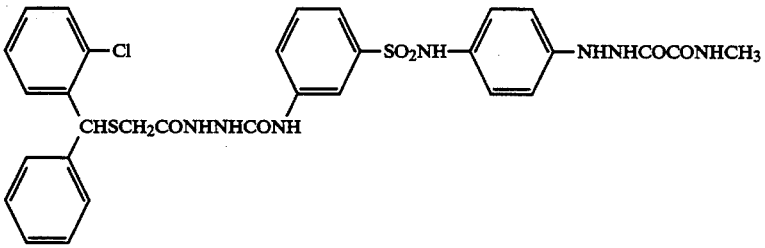
I-93
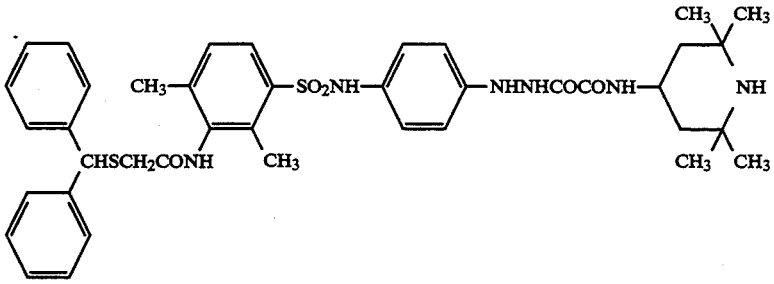
I-94
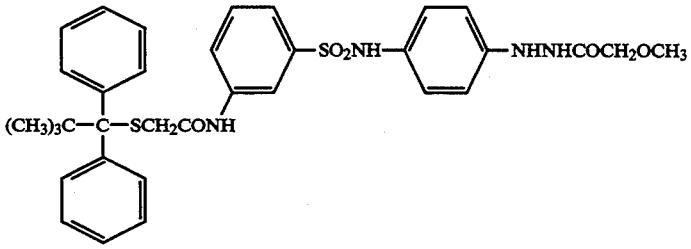

-continued
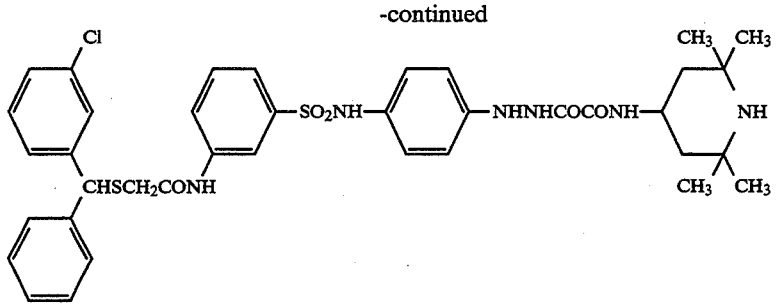
I-95
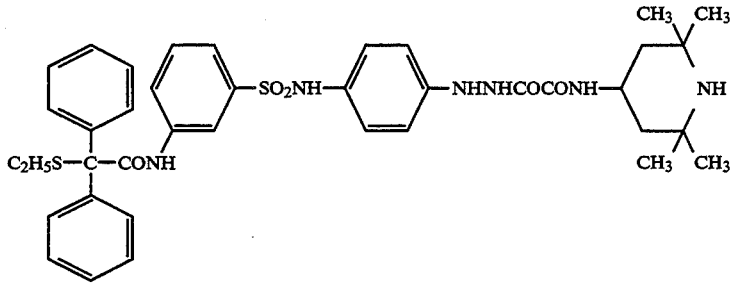
I-96
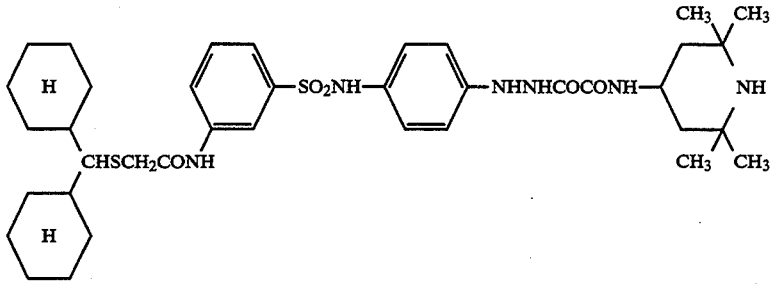
I-97
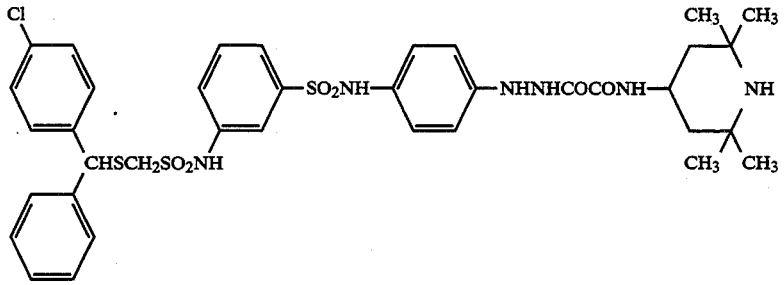
I-98
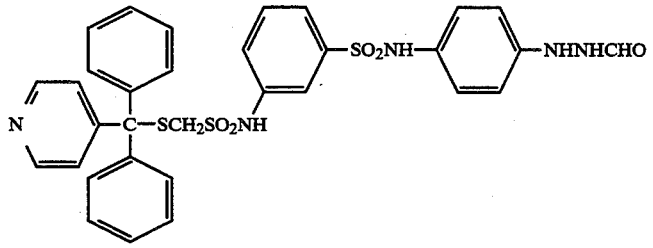
I-99
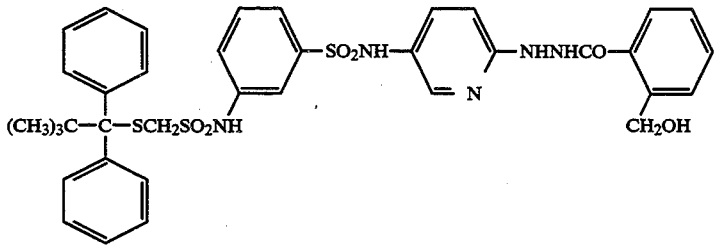
I-100

-continued
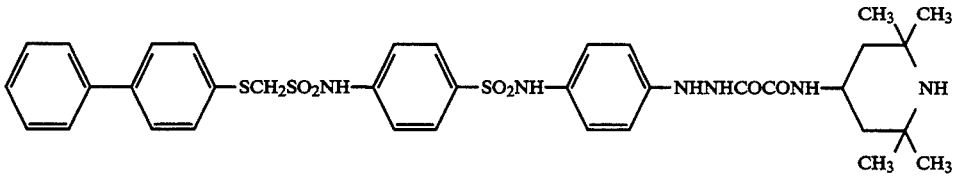
I-101
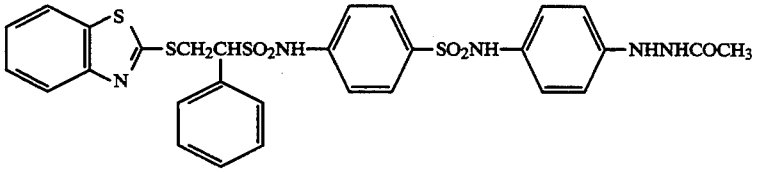
I-102
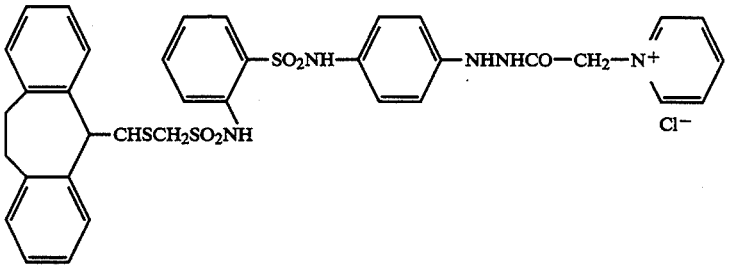
I-103
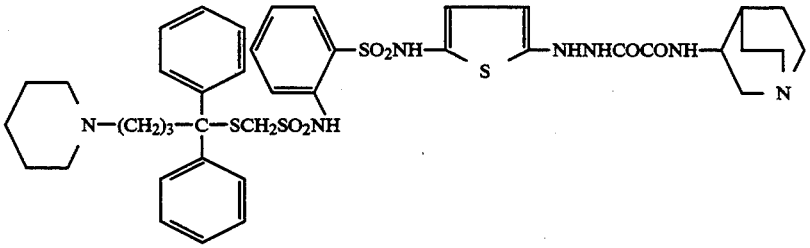
I-104
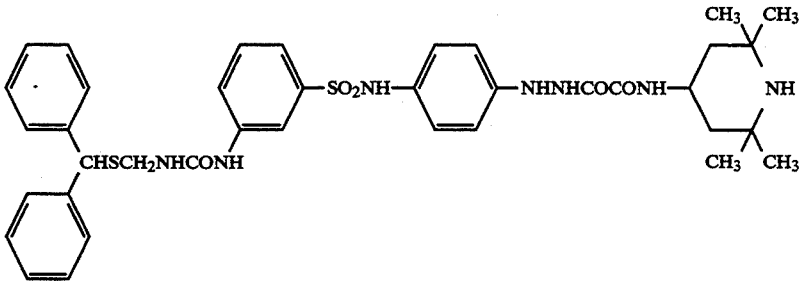
I-105
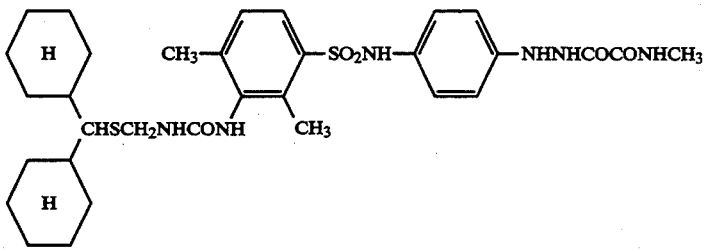
I-106

-continued
I-107
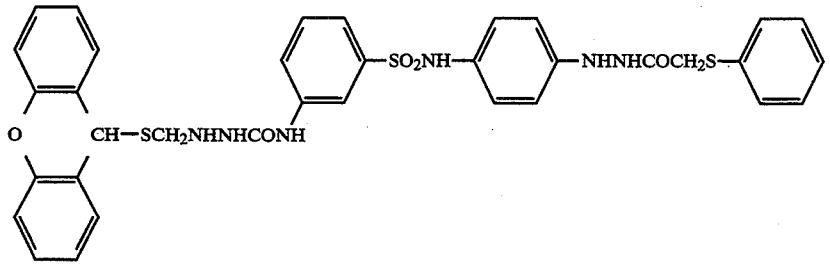
I-108
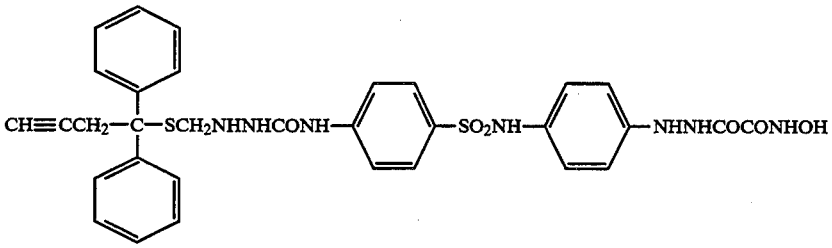
I-109
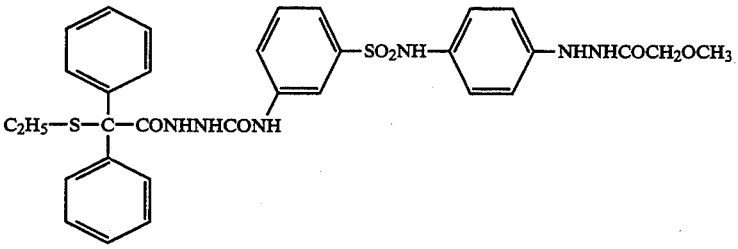
I-110
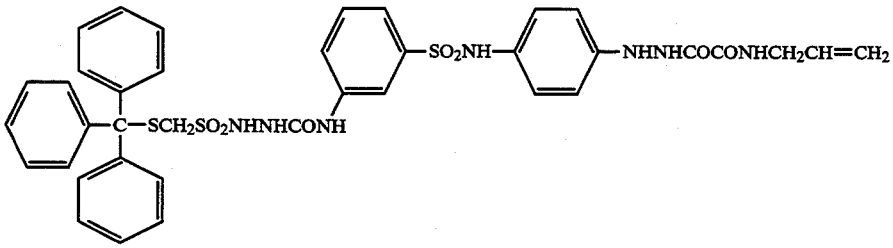
I-111
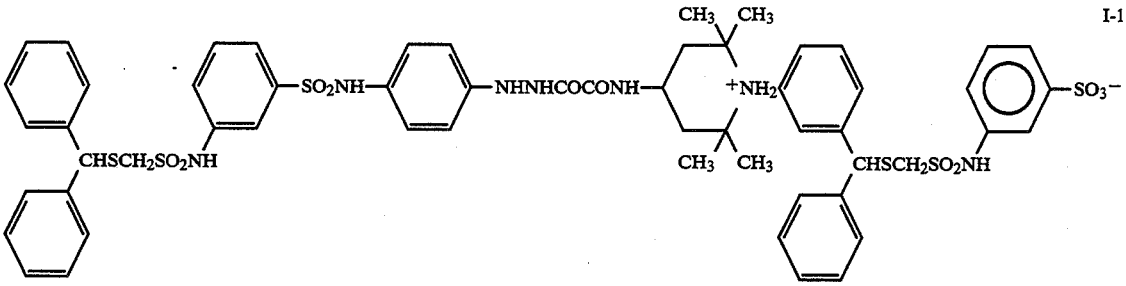
I-112
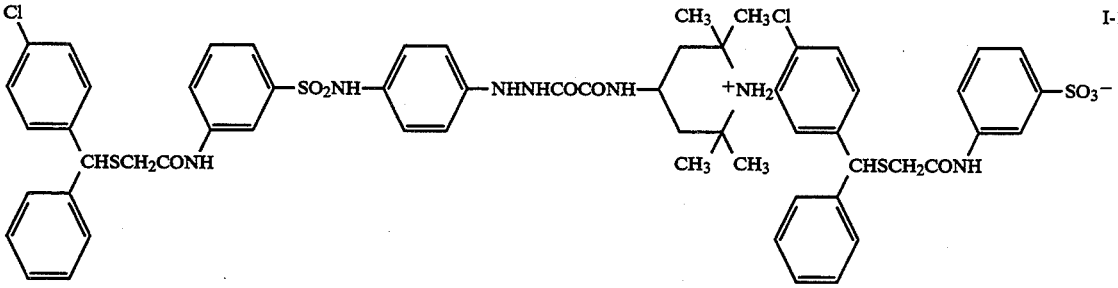

-continued

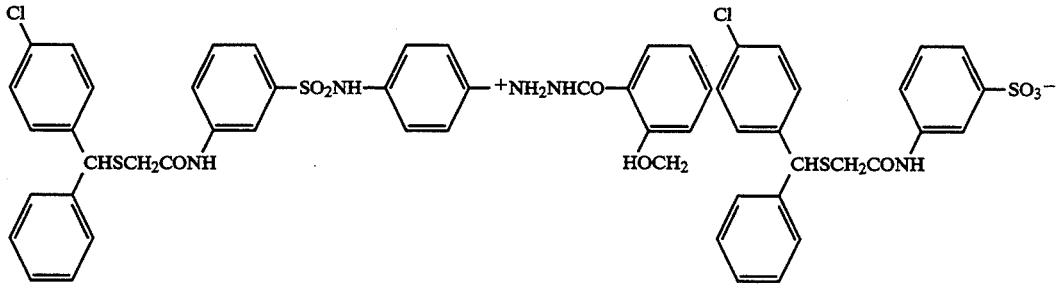

I-113

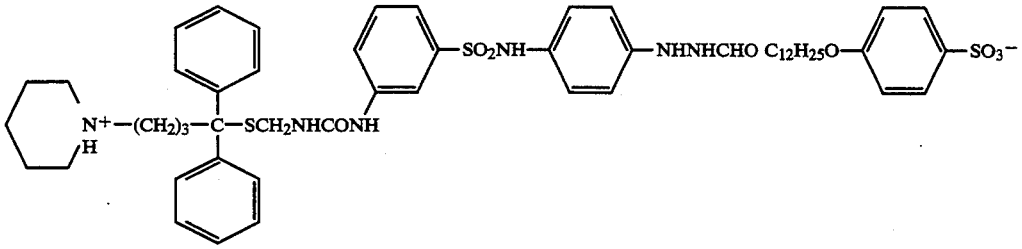

I-114

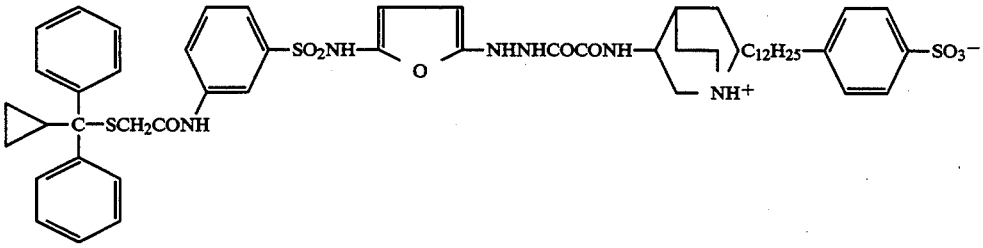

I-115

Next, the examples of the procedures for synthesizing the compounds of the invention represented by Formula [I] will be detailed below.

The compound of the invention can be synthesized in accordance with the disclosure of JP OPI Publication Nos 3-259240/1991, 5-45762/1993 and U.S. Pat. No. 4,988,604.

(Synthesis of Compound I-37)

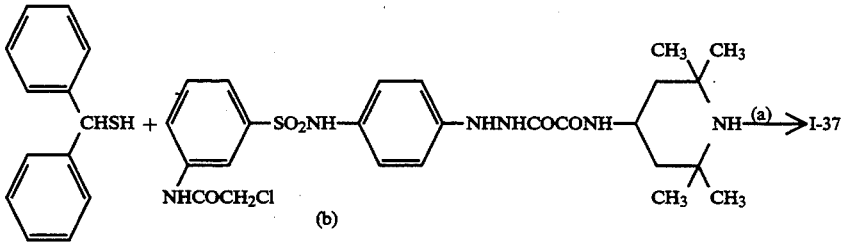

After 1.63 g of compound (a) was dissolved in 9 cc of dimethylformamide, sodium hydride was gradually added thereto. Thereafter, the reaction vessel was dipped in a ice bath to be cooled down to a temperature of 5° C. and then 4.18 g of compound (b) was dropwise added thereto over a period of 30 min. After allowed to react for 5 hrs., the mixture was poured in water and solid product was filtered. The crude product was purified by column chromatography to obtain 0.95 g of the objective material, milky white-colored solid product (yield: 18%). The structure of the product was confirmed with NMR and MS. Compound I-37 can also be synthesized through another route (1) or (2) as follows.

(1)

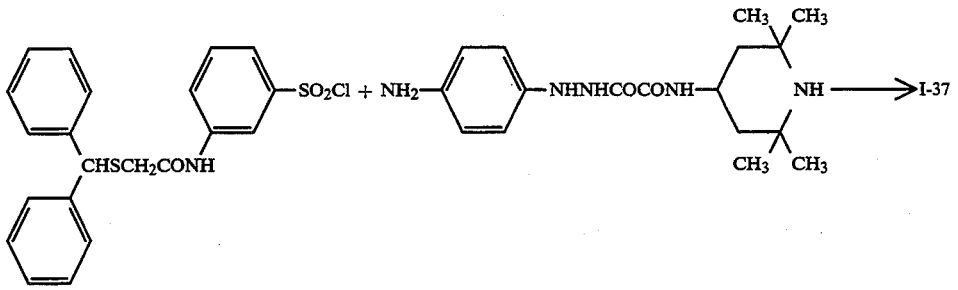

(2)

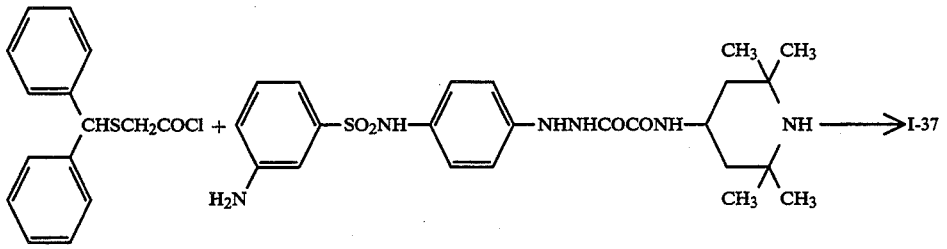

(Synthesis of compound I-112)

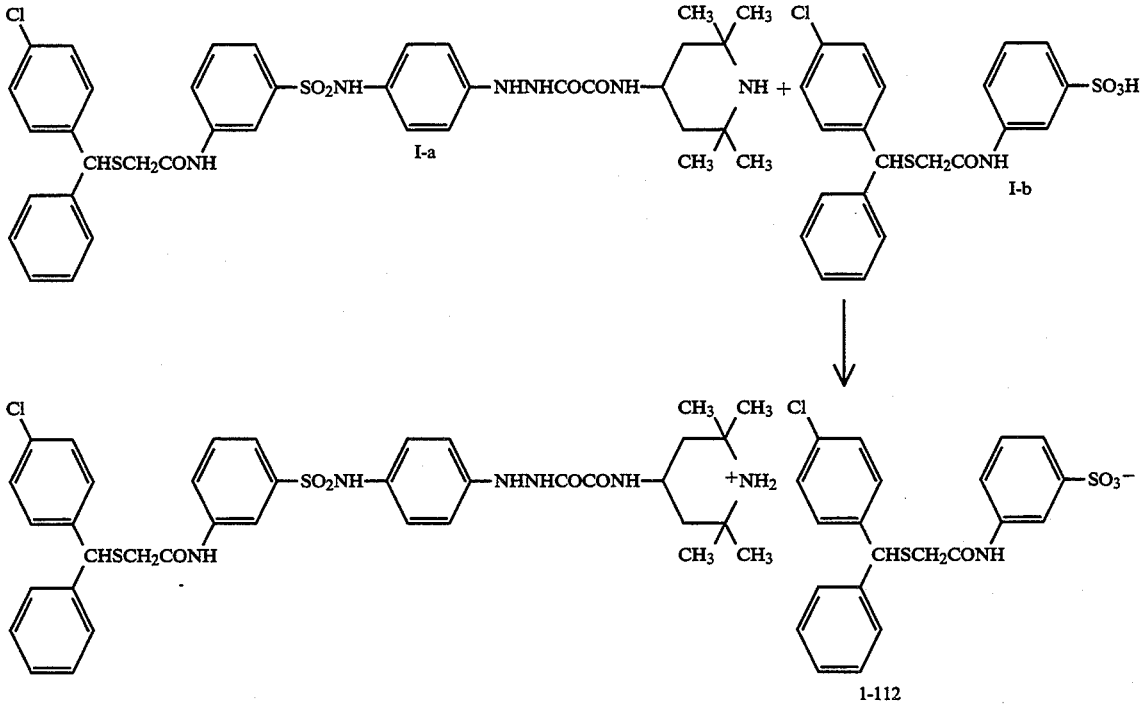

7.6 g of compound I-a was dissolved in 50 cc of methanol, and 4.5 g of compound I-b was gradually added thereto. After stirring the mixture for 30 min., methanol was distilled away under reduced pressure to obtain 12.1 g of objective material. The structure of the compound was confirmed with NMR and MS.

Compound I-112 can also be synthesized through the following route.

(1)
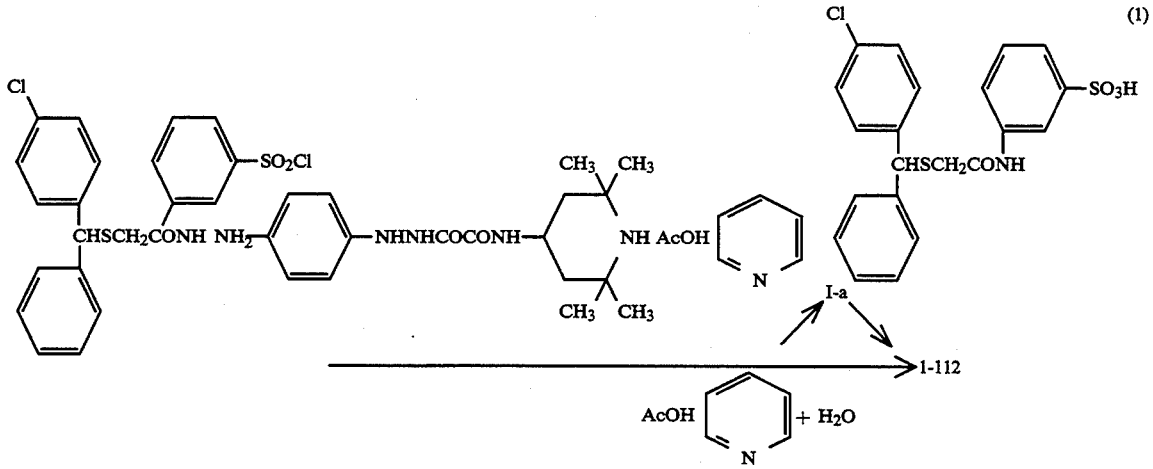
(2)
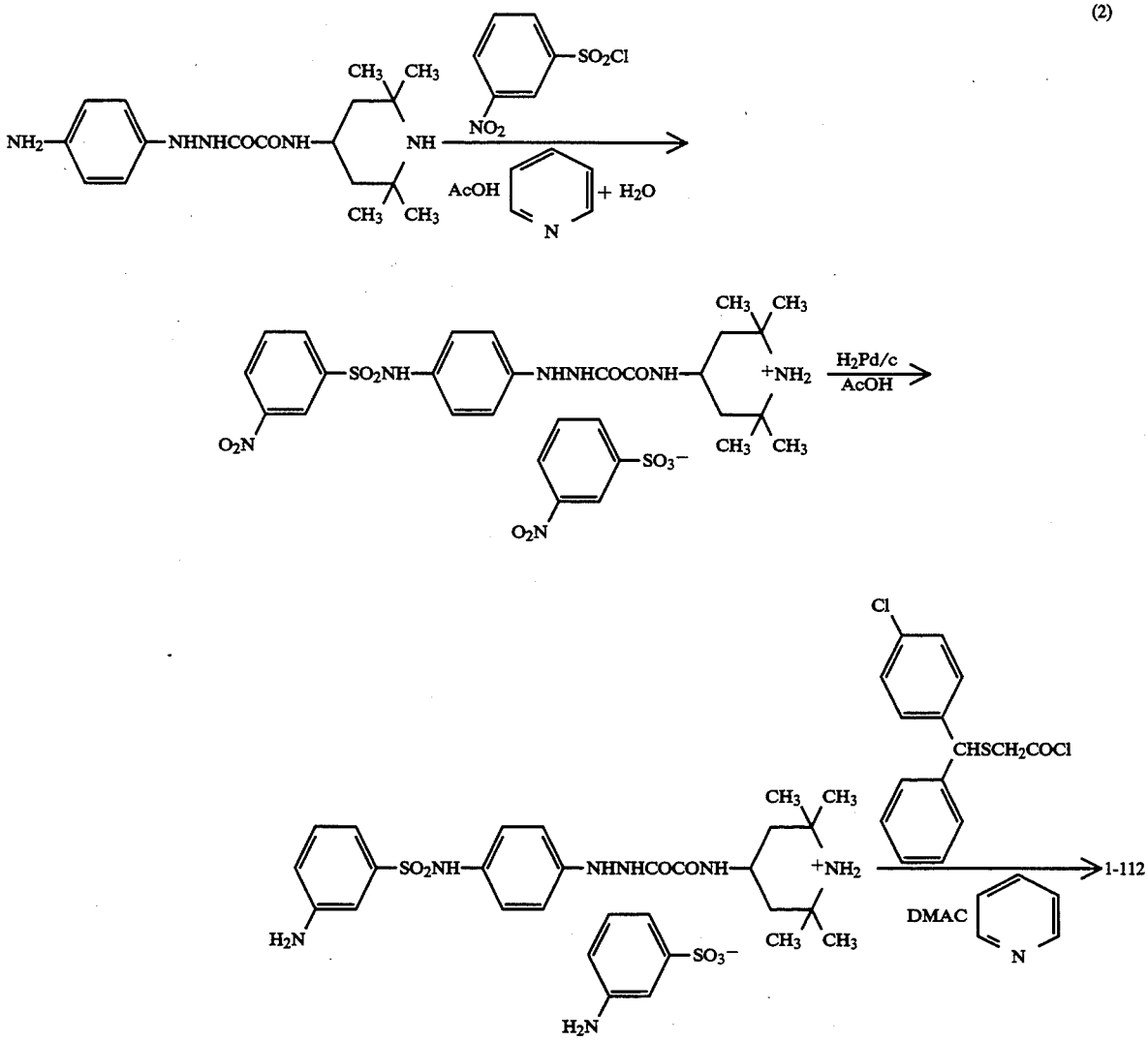
As to contrast-increasing by the compound of the invention, the reaction thereof can be illustrated as follows.

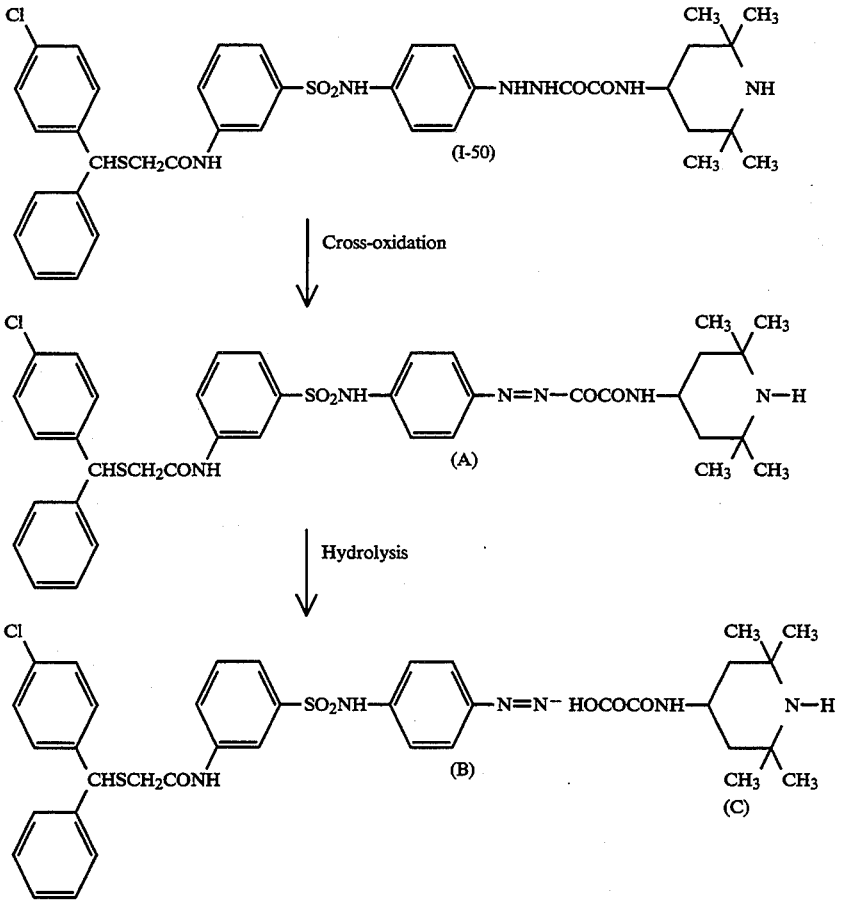

In the process of development, compound I-50 reacts, through cross-oxidation, with an imagewise-produced oxidation product of a deloper to form an azo compound (A), which is further hydrolyzed to form (B) and (C). (B) is considered to function as activated nucleating species, which act on silver halide grain surface to produce a contrast increase. The mechanism as above-mentioned can be applied to other hydrazine compounds of the invention.

Next, preferred embodiments of the present invention will be given as below.

A compound represented by Formula (I) is contained, as a contrast-increasing agent, in a light sensitive material of the invention which leads to a high contrast image. The compound of formula (I) is contained preferably in an amount of $5\times10^{-7}$ to $5\times10^{-1}$, more preferably, $5\times10^{-6}$ to $5\times10^{-2}$ mol per silver halide of the light sensitive material.

The silver halide photographic light sensitive material of the invention has at least one silver halide emulsion layer. To be more concrete, there may be some instances where at least one silver halide emulsion layer may be provided to one side of the support of the light sensitive material or where at least one layer is provided on both sides of the support. The silver halide emulsion is coated directly on the support or coated thereon by interposing the other layer such as a hydrophilic colloidal layer not containing any silver halide emulsion between the emulsion and the support. It is further allowed that a hydrophilic colloidal layer may be coated as a protective layer on the silver halide emulsion layer. The silver halide emulsion layer may be coated upon dividing it into two layers having different photographic speeds, namely, a high speed silver halide emulsion layer and a low speed silver halide emulsion layer. When this is the case, an interlayer may also be interposed between the two silver halide emulsion layers. In other words, it is also allowed to interpose an interlayer comprising hydrophilic colloid therebetween if required. It is further allowed to interpose a non-light-sensitive hydrophilic colloidal layer such as an interlayer, a protective layer, an antihalation layer and a backing layer between the silver halide emulsion layer and the protective layer.

In order to function as a contrast-increasing agent, the compound represented by Formula (I) is contained preferably in a hydrophilic layer of the light sensitive material, more preferably in a silver halide emulsion layer and/or a hydrophilic layer adjacent to the silver halide emulsion layer.

Next, silver halides applicable to the silver halide photographic light sensitive material of the invention will be detailed. The silver halides include, for example, silver chloroiodo-bromide and silver iodobromide each containing silver iodide of not more than 4 mol % and, preferably, not more than 3 mol %. The above-mentioned silver halide grains desirably applicable thereto have an average grain size within the range of 0.05 to 0.5 μm and, more suitably, 0.10 to 0.40 μm.

The silver halide grains to be used in the invention may have any grain-size distribution, however, those having a value of 1 to 30% for monodispersity as defined below are preferable. More preferably, the value is so controlled as to be within the range of 5 to 20%.

The term "monodispersity" stated herein is defined as below.

Monodispersity (%)=(standard deviation of grain size distribution)/(an average grain size)×100

Monidispersity is alternatively called "variation coefficient". For convenience, the grain size of a silver halide grain is represented by an edge length in the case of a cubic crystal grain and is calculated out by the square root of a projective area in the cases of the other (octahedral or tetradecahedral) grains.

In the embodiment of the invention, silver halide grains having double-layered or multilayered structure can be used. For example, it is allowed to use silver chlorobromide or chloroiodobromide grains consisting of a core comprising silver chloride or silver iodobromide, and a shell comprising silver bromide, otherwise, a core comprising silver bromide and a shell comprising silver chloride, wherein it is also allowed to contain iodide in an amount of not more than 5 mol % in any layers.

To the silver halide grains applicable to the silver halide emulsions of the invention, metal ions are added by making use of at least one kind of the metal salts selected from the group consisting of a cadmium salt, a zinc salt, a lead salt, a thallium salt, an iridium salt (including the complex salts thereof), a rhodium salt (including the complex salts thereof) and an iron salt (including the complex salts thereof), in the course of nuclear-forming and/or growing the grains, so that these metal ions may be contained in the insides and/or surfaces of the grains. Also, reduction-sensitizing nuclei can be provided to the insides and/or surfaces of the grains, by subjecting them to a suitable reducible atmosphere.

Further, the silver halides can be sensitized by making use of various kinds of chemical sensitizers including, for example, active gelatin, a sulfur sensitizer (e.g., sodium thiosulfate, allyl thiocarbamide, thiourea and allyl isocyanate), a selenium sensitizer (e.g., N,N-dimethyl selenourea and selenourea), a reduction sensitizer (e.g., triethylene tetramine and stannous chloride) and various kinds of noble-metal sensitizers typified by potassium chloroaurite, potassium aurithiocyanate, potassium chloroaurate, 2-aurosulfobenzothiazole methyl chloride, ammonium chloropalladate, potassium chloroplatinate and sodium chloropalladite, and these sensitizers may be used either independently or in combination. In addition to the above, ammonium thiocyanate may also be used assistantwise when a gold sensitizer is used therein.

The characteristics of the silver halide grains applicable to the invention can be enhanced by ripening the grains with the above-given chemical sensitizers, because the grains can be desirably used as the silver halide grains which have a high surface sensitivity as compared to the internal sensitivity thereof, that is, the silver halide grains capable of providing the so-called negative images.

The silver halide emulsions applicable to the invention can be stabilized or antifogged by making use of a mercapto-containing compound (such as 1-phenyl-5-mercaptotetrazole and 2-mercaptobenzothiazole), a benzo-triazole (such as 5-bromobenzotriazole and 5-methylbenzotriazole) or a benzoimidazole (such as 6-nitrobenzoimidazole).

The silver halide emulsion of the invention may contain as a nucleation-accelerating agent, compounds as disclosed in JP OPI Publication Nos. 53-77616/1978, 53-137133/1978, 54-37732/1979, 60-140340/1985, 60-14959/1985, 2-97939/1990, and U.S. Pat. No. 4,998,604, a amine compound having a ballast group or a adsorption-accelerating group and an alcoholic compound such as diphenylcarbinol.

A nucleation-accelerating agent is contained in an amount of $2\times10^{-5}$ to $2\times10^{-1}$, preferably $1\times10^{-4}$ to $1\times10^{-2}$ mol per mol of silver halide.

Representative examples of nucleation-accelerating agents will be given below.

$(C_3H_7)_2N(CH_2CH_2O)_8CH_2CH_2N(C_3H_7)_2$ B-1

B-2

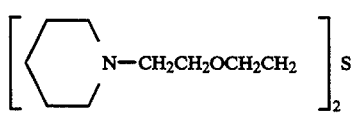

B-3

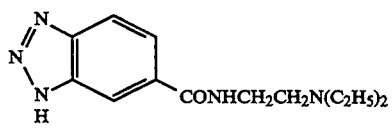

B-4

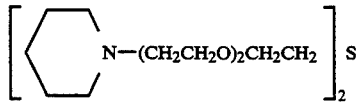

$(C_3H_7)_2N(CH_2CH_2O)_2(CHCH_2O)_7CH_2CH_2OCH_2CH_2N(C_3H_7)_2$ B-5
$\quad\quad\quad used as the binder for the hydrophilic colloidal layers. Any other hydrophilic colloids than gelatin can also be used for. Supports usable in the invention include, for example, baryta paper, polyethylene-coated paper, polypropylene synthetic paper, glass plate, cellulose acetate, cellulose nitrate and polyester film such as those made of polyethylene terephthalate. These supports may be suitably selected so as to meet the uses of silver halide photographic light sensitive materials.

For developing the silver halide photographic light sensitive materials to obtain a high-contrast image, for example, the following developing agents can be used.

Typical HO—(CH=CH)$_n$—OH type developing agents include hydroquinone and, besides, catechol, pyrogallol and so forth.

Typical HO—(CH=CH)$_n$—NH$_2$ type developing agents include ortho or para aminophenol or aminopyrazolone and, besides, N-methyl-p-aminophenol, N-$\beta$-hydroxyethyl-p-aminophenol, p-hydroxyphenyl aminoacetic acid, 2-aminonaphthol and so forth.

Heterocyclic type developing agents include, for example, 3-pyrazolidones such as 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4-methyl-4-hydroxymethyl-3-pyrazolidone.

Besides the above, there are also developing agents effectively applicable to the invention, such as those given in T. H. James, 'The Theory of the Photographic Process', 4th edition, pp.291~334 and 'Journal of the American Chemical Society' Vol.73, p.3,100 (1951). These developing agents may be used independently or in combination. However, the combination use thereof is more desirable.

Even when the developers for developing the light sensitive materials of the invention are used together with a sulfite such as sodium sulfite and potassium sulfite as a preservative, the effects of the invention shall not be spoiled. Hydroxylamine or a hydrazide compound may also be used as a preservative. Besides the above, the pH controlling and buffering functions can also be provided by making use of such a caustic alkali, alkali carbonate or amine as generally used in a black-and-white developer. If desired, the developers are allowed to be added with an inorganic development inhibitor such as potassium bromide; an organic development inhibitor such as 5-methylbenzotriazole, 5-methylbenzoimidazole, 5-nitroindazole, adenine, guanine and 1-phenyl-5-mercaptotetrazole; a metal-ion scavenger such as ethylenediamine tetraacetic acid; a development accelerator such as methanol, ethanol and benzyl alcohol; a surfactant such as sodium alkylarylsulfonate, natural saponin, sugar and the alkyl esters of the above-given compounds; a layer hardener such as glutaraldehyde, formalin and glyoxal; and an ionic strength controller such as sodium sulfate.

The developer of the invention may contain a organic solvent such as alkanol amines and glycols.

The photographic material of the present invention may also be used as a direct positive light sensitive material and in this case the following mode is preferred.

The compound represented by the general formula (I) can be used as a foggant. In the following description, the compound (I) which functions as a foggant shall be named "the foggant of the present invention".

At least one of the foggants of the present invention may be incorporated in such a way that it fogs an internally latent image forming silver halide emulsion (i.e., an emulsion that provides a direct positive image) during development after imagewise exposure. Stated more specifically, the foggant of the present invention only need be incorporated in the light sensitive material in such a way that the light sensitive material which contains an internally latent image forming silver halide emulsion can be developed in the presence of the foggant after exposure.

In a preferred embodiment, at least one of the foggants of the present invention is incorporated in a silver halide emulsion layer or an adjacent layer thereto (e.g., a silver halide light sensitive layer, an intermediate layer, a filter layer, a protective layer or an anti-halation layer).

The amount in which the foggant of the present invention is used can vary over a broad range depending on the characteristic on the silver halide emulsion used, the type of foggant and the conditions of development but it only need be used in an amount that provides a positive image when the photographic material having an internal latent image forming silver halide emulsion is developed with a surface developing solution after imagewise exposure. Desirably, the amount of the foggant to be used is such that it is sufficient to provide an adequate maximum density (e.g., 2.0 or more) after development.

The foggant of the present invention is preferably incorporated in the silver halide emulsion in such a way that at a suitable time after the end of ripening, the foggant is present in an amount of ca. $10^{-5}$ to $10^{-1}$ mol per mol of silver halide.

Silver halide developing agents that can be used in the step of development in the practice of the present invention include hydroquinones, catecols, aminophenols, 3-pyrazolidones, ascorbic acid or derivatives thereof, reductones,phenylenediamines and mixtures thereof. If desired, these developing agents may be previously incorporated in the emulsion so that they will act on silver halides during immersion in high pH aqueous solution.

The developing composition to be used in developing the direct positive silver halide photographic material in the practice of the present invention may further contain specified antifoggants and development restrainers. If desired, such developing composition may be incorporated in any coating or layer in the silver halide photographic material. Useful antifoggants include: benzotriazoles such as 5-methylbenzotriazole; 1-phenyl-5-mercaptotetrazoles; heterocyclic thiones such as 1-methyl-2-tetrazoline-5-thione; and aromatic or aliphatic mercapto compounds such as 1-phenyl-5-mercaptotetrazole.

When the present invention is applied to a direct positive silver halide photographic material, the silver halide emulsion to be used is an internal latent image forming silver halide emulsion, namely an emulsion that has silver halide grains in the interior of which a latent image is to be predominantly formed and which contain in its interior the greater part of sensitivity specks. Any silver halides may constitute such emulsions and they include, for example, silver bromide, silver chloride, silver chlorobromide, silver iodobromide and silver chloroiodobromide.

A suitable emulsion may be determined by conducting the following test: part of a sample having an emulsion of interest coated on a transparent support is exposed to light intensity scale for a fixed period up to about one second and subsequently developed at 20° C. for 4 min. with a surface developing solution A having the recipe shown below which is substantially free from a silver halide solvent and which develops only the surface image on the grains; another part of the same emulsion sample is exposed similarly and developed at 20° C. for 4 min. with an internal developing solution B having the recipe shown below which develops the internal image in the grains. A preferred emulsion is such that the maximum density achieved by development with solution A is not high than a fifth of the maximum density achieved by development with solution B. More preferably, the maximum density achieved by development with solution A is not high than a tenth of the maximum density achieved by development with solution B

| | |
|---|---|
| Surface developing solution A | |
| Metol | 2.5 g |
| L-Ascorbic acid | 10 g |
| $NaBO_2 4H_2O$ | 20 g |
| KBr | 1 g |
| Water | to make 1000 ml |
| Internal developing solution B | |
| Metol | 2.0 g |
| Sodium sulfite (anhydrous) | 90 g |
| Hydroquinone | 8.0 g |
| Sodium carbonate ($H_2O$) | 52.5 g |
| KBr | 5.0 g |
| KI | 0.5 g |
| Water | to make 1000 ml |

The internal latent image forming silver halide emulsion to be used in the present invention may be prepared by various methods and exemplary emulsions include: the halide-converted silver halide emulsion described in U.S. Pat. No. 2,592,250; the silver halide emulsion containing internally chemically sensitized silver halide grains as described in U.S. Pat. Nos. 3,206,316, 3,317,322, 3,367,778, and JP Examined Publication 43-29405/1968; the silver halide emulsion having silver halide grains incorporating polyvalent metal ions as described in U.S. Pat. Nos. 3,271,157, 3,447,927, and 3,531,291; the silver halide emulsion comprising grains a multilayered structure as described in JP OPI Publication 50-8524/1975; and the silver iodohalide emulsion prepared by an ammoniacal method described in JP OPI publication 52-156614/1977.

Compounds having azaindene ring or nitrogen-containing heterocyclic compounds having a mercapto group may be contained in the internal latent image forming silver halide emulsion in preferred amounts of 1 mg–10 g per mol of silver halide and this is effective for the purpose of achieving more consistent results at a lower minimum density. A preferred example of the compounds having an azaindene ring is 4-hydroxy-6-methyl-1,3,3a,7-tetrazaindene. Exemplary nitrogen-containing heterocyclic compounds having a mercapto group include a pyrazole ring, 1,2,4-triazole ring, 1,2,3-triazole ring, 1,3,4-thiadiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, 1,2,4-triazine ring, 1,3,5-triazine ring, and rings consisting of two or three of these rings condensed together as exemplified by a triazolotriazole ring, diazaindene ring, triazaindene ring, tetrazaindene ring, pentazaindene ring, as well as a phthalazazinone and indole rings. Among these, 1-phenyl-5-mercaptotetrazole is preferred.

The silver halide photographic material of the present invention, if it is to be used as a positive light sensitive material, may be a black-and-white photographic material or a monochlomatic or multi-color photographic material. If it is to be used as a full-color photographic material, it is preferably designed to have a blue-sensitive silver halide emulsion layer containing a yellow coupler, a green-sensitive silver halide emulsion layer containing a magenta coupler, and a red-sensitive silver halide emulsion layer containing a cyan coupler.

In a preferred embodiment, the blue-sensitive, green-sensitive and red-sensitive layers are superposed on a support in such a way that the blue sensitive layer being the farthest from the support, with a non-light-sensitive layer (yellow filter layer) being provided between the blue sensitive and green-sensitive layers.

Known acylacetoanilide compounds may be used as yellow couplers and among them, benzoylacetoanilide and pivaloylacetoanilide compounds are used with particular advantage. Usable magenta couplers include 5-pyrazolone compounds, pyrazoloazole compounds and open-chain acylacetonitrile compounds. Naphthoic and phenolic compounds may preferably be used as cyan couplers.

Besides the light sensitive silver halide emulsion layers and non-light-sensitive layer which serves as a yellow filter layer, the support may also have provided thereon many other photographic constituent layers such as an interlayer, a protective layer, a subbing layer, a backing layer, and and an anti-halation layer. These layers may be coated by any suitable methods such as dip-coating, air-doctor coating, extrusion coating, sliding-hopper coating or curtain flow coating.

When the silver halide photographic material of the present invention is to be used as a direct positive light sensitive material, various support may be used, as exemplified by polyethyleneterephthalate films, polycarbinate films, polystyrene films, polypropylene films, cellulose acetate films, glass sheets, baryta paper and polyethylene laminated paper. These supports may be subbed as required. These supports may be opaque or transparent depending on the type of light sensitive material to be used.

The silver halide emulsion in the light sensitive material may contain various photographic additives such as a wetting agent, a film property improving agent, and a coating aid in accordance with the specific object of use. Other photographic additives that can be used include a gelatin plastcizer, a surfactant, a UV absorber, a pH modifier, an antioxidant, an antistatic agent, a thickner, a granularity improving agent, a dye, a mordant, a brightener, a development modifier and a matting agent.

In order to prevent the fading of dye image due to actinic radiation at shorter wavelengths, UV absorbers such as thiazolidone, benzotriazole, acrylonitrile and benzophenone compounds can advantageously be used.

Gelatin and appropriate gelatin derivatives (which should be selected depending on the object) may be used as a protective colloid or binder in the silver halide emulsion layer. Depending on the object, other hydrophilic binder may also used. Such binders may be added to the emulsion layer or other photographic constituent layers such as n interlayer, protective layer, a filter layer and a backing layer. A plastcizer or wetting agent may be incorporated in the hydrophilic binders.

The individual photographic constituent layers of the light sensitive material may be hardened with any suitable hardeners.

The light sensitive material may also have as AS (antistain) agent incorporated therein.

EXAMPLES

The typical examples of the invention will be detailed below, but the embodiments of the invention shall not be limited thereto.

Example 1

Samples were prepared by adding an exemplified compound represented by Formula (I) or a comparative compound (C-1, 2 or 3 as shon below) into a silver halide emulsion layer of a light sensitive material in accordance with the following procedure.

On one of the 0.1 μm-thick layers undercoated on both sides of a 100 μm-thick polyethyleneterephthalate film, a silver halide emulsion layer having the following chemical formula (1) was so coated as to have a gelatin content of 1.5 g/m$^2$ and a silver content of 3.3 g/m$^2$ and an emulsion protective layer having the following chemical formula (2) was then so coated thereon as to have a gelatin content of 1.0 g/m$^2$. Further, on another undercoated layer on the opposite side of the film, a backing layer having the following chemical formula (3) was so coated as to have a gelatin content of 3.5 g/m$^2$ and a backing protective layer having the following chemical formula (4) was so coated thereon as to have a gelatin content of 1.0 g/m$^2$, so that Samples No.1 through No. 16 were prepared.

| Formula 1 (Composition of silver halide emulsion layer) | |
|---|---|
| Gelatin | 1.5 g/m$^2$ |
| Silver chlorobromide emulsion A (AgCl:60 mol %, AgBr:40 mol %, Monodispersity:12%) | 3.3 g/m$^2$ |
| 4-Hydroxy-6-methyl-1,3,3a,7-tetrazaindene | 0.3 g/m$^2$ |
| Inventive or Comparative compound as shown in Table 1 | |
| Nucleation-accelerating agent as shown in Table 1 | |
| Surfactant: Saponin | 0.1 g/m$^2$ |
| Latex polymer: Polyethylacrelate | 1.0 g/m$^2$ |
| Sensitizing dye (a) | 5 mg/m$^2$ |
| Sensitizing dye (b) | 15 mg/m$^2$ |
| Sensitizing dye (c) | 15 mg/m$^2$ |
| Sensitizing dye (d) | 10 mg/m$^2$ |
| Sensitizing dye (e) | 3 mg/m$^2$ |
| Developing modifier | 10 mg/m$^2$ |
| Nonylphenoxy-poethyleneglycol | |
| 5-Methylbenzotriazole | 7 mg/m$^2$ |
| Adenine | 3 mg/m$^2$ |
| Guanine | 2 mg/m$^2$ |
| Urasil | 2 mg/m$^2$ |
| 1-Phenyl-5-mercaptotetrazole | 3 mg/m$^2$ |
| hydroquinone | 100 mg/m$^2$ |
| 1-Phenyl-3-pyrazolidone | 10 mg/m$^2$ |

Sensitizing dye (a)

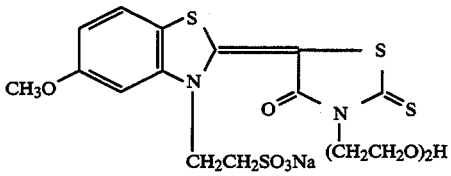

Sensitizing dye (b)

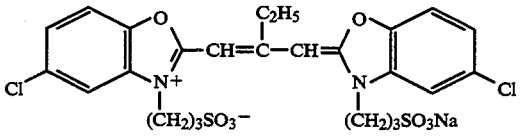

Sensitizing dye (c)

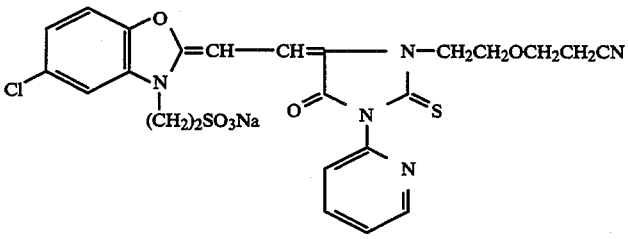

Sensitizing dye (d)

-continued

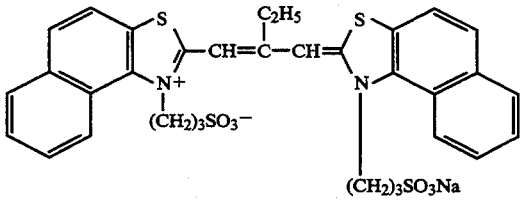

Sensitizing dye (e)

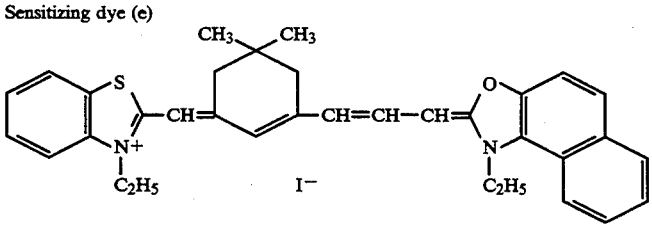

| Formula 2 (Composition of the protective layer) | |
|---|---|
| Gelatin | 1.0 g/m$^2$ |
| Matting agent: Polymethylmethaacrylate having an average size of 3.0 to 5.0 μm | 50 mg/m$^2$ |
| Surfactant: Sodium Dodecylbenzenesulfonate | 10 mg/m$^2$ |
| Static Modifier: $C_8F_{17}COONH_4$ | 10 mg/m$^2$ |
| Sodium chloride | 100 mg/m$^2$ |
| Lithium chloride | 30 mg/m$^2$ |
| Stabilizer: Sodium 2-mercaptobenzimidazolesulfonate | 5 mg/m$^2$ |
| 1-Phenyl-5-mercaptotetrazole | 3 mg/m$^2$ |
| Hardener: Formalin | 30 mg/m$^2$ |

| Formula 3 (Composition of emulsion backing layer) | |
|---|---|
| Gelatin | 3.5 g/m$^2$ |
| Dye-1 | 1 g/m$^2$ |
| Dye-2 | 1 g/m$^2$ |
| Surfactant: Saponin | 0.1 g/m$^2$ |
| Hardener: Glyoxal | 0.1 g/m$^2$ |

Dye-1

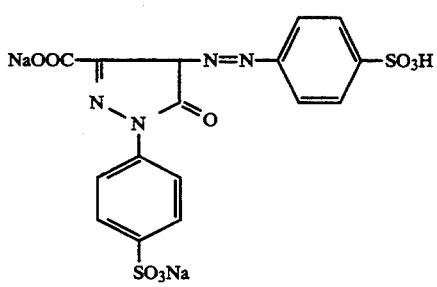

Dye-2

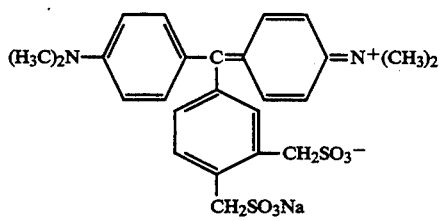

| Formula 4 (Composition of backing protective layer) | |
|---|---|
| Gelatin | 1 g/m$^2$ |
| Matting agent: Polymethyl methacrylate having an average particle size of 3.0~5.0 μm | 0.5 g/m$^2$ |
| Surfactant: Sodium Dodecylbenzenesulfonate | 10 mg/m$^2$ |

-continued

| Formula 4 (Composition of backing protective layer) | |
|---|---|
| $C_8F_{17}SO_2NH(CH_2)_3N^+(CH_3)_2CH_2COO^-$ | 10 mg/m$^2$ |
| Developing modifier:5-Nitroindazole | 12 mg/m$^2$ |
| 5-Methylbenzotriazole | 20 mg/m$^2$ |
| 1-Phenyl-5-mercaptotetrazole | 5 mg/m$^2$ |
| Hardener: Formalin | 30 mg/m$^2$ |

The resulting samples were each subjected to the halftone dot quality tests in the following manner.

Halftone Dot Quality Test Procedures

A step-wedge was partially attached with a contact halftone screen (150 lines/inch) having a halftone dot area of 50%. A sample was brought into close contact with the above step-wedge and was then exposed to a Xenon light source for 5 seconds. The exposed sample was developed through an automatic processor for rapid processing upon putting the following developer and fixer therein under the following conditions. The resulting halftone dot quality of the sample was observed through a 100× magnifier. The results of the observation were evaluated in terms of five ranks; [5] for the highest halftone dot quality and [4], [3], [2] and [1] in order for the lower qualities, respectively.

The resulting fogginess in the halftone dots were also evaluated in a manner similar to the above and the samples having no black dot at all were evaluated to be the highest rank [5] and the ranks [4], [3], [2] and [1] according to the order of how many black dots were produced, respectively.

| Formula of Developer | |
|---|---|
| (Composition A) | |
| Water (Deionized water) | 150 cc |
| Sodium ethylenediamine tetraacetate | 2 g |
| Diethyleneglycol | 50 g |
| Potassium sulfite (55% w/v aq. solution) | 100 cc |
| Potassium carbonate | 50 g |
| Hydroquinone | 15 g |
| 5-methylbenzotriazole | 200 mg |
| 1-Phenyl-5-mercaptotetrazole | 30 mg |
| Sodium hydroxide, amounts necessary to make pH to 10.4 | |
| Potassium bromide | 3 g |
| (Composition B) | |
| Water (Deionized water) | 3 cc |
| diethyleneglycol | 50 g |
| Sodium ethylenediaminetetraacetate | 25 mg |
| Acetic acid (90% aq.solution) | 0.3 cc |
| 5-Nitroindazole | 110 mg |

-continued

| Formula of Developer | |
|---|---|
| Sodium 2-mercaptobenzimidazole-5-sulfonat | 30 mg |
| 1-Phenyl-3-pyrazolidone | 500 mg |

Into 500 cc of water, above composites A and B were added in this order to make a total volume of 1 liter.

| Formula of Fixer | |
|---|---|
| (Composition A) | |
| Ammonium thiosulfate (in an aqueous 72.5 w/v% solution) | 240 ml |
| Sodium sulfite | 17 g |
| Sodium acetate · trihydrate | 6.5 g |
| Boric acid | 6 g |
| Sodium citrate · dihydrate | 2 g |
| Acetic acid (90% solution) | 13.6 cc |
| (Composition B) | |
| Water (ion-exchange water) | 17 cc |
| Sulfuric acid (in an aqueous 50% w/w solution) | 4.7 g |
| Aluminium sulfate (an aqueous solution of 8.1 w/w % in terms of $Al_2O_3$ content) | 26.5 g |

When the fixer was used, the above-given Compositions A and B were dissolved in order in 500 ml of water so as to make 1 liter in total. The pH of the fixer was adjusted to be 4.3 with acetic acid.

| | (Process) | |
|---|---|---|
| Processing step | Temperature | Time |
| Developing | 38° C. | 30 sec. |
| Fixing | 28° C. | 20 sec. |
| Washing | Ordinal temperature | 20 sec. |

As for the comparative compounds to the hydrazine compounds of the invention added into the silver halide emulsion layers in Formula (1), the following compounds C-1, 2 and 3 were each added.

(U.S. Pat. No. 4,988,504)

C-1

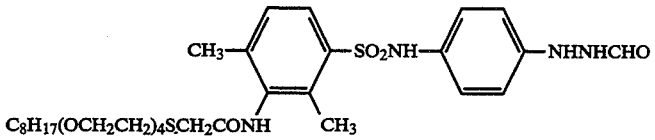

C-2

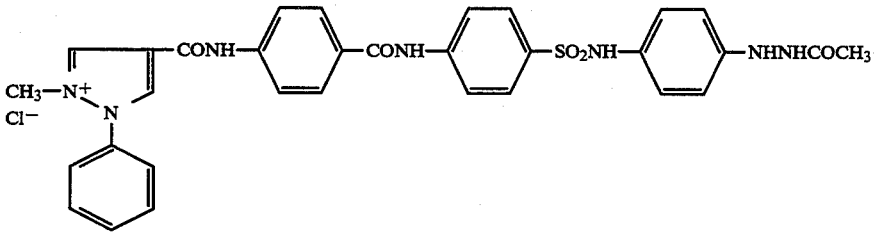

(U.S. Pat. No. 5,041,355)

C-3

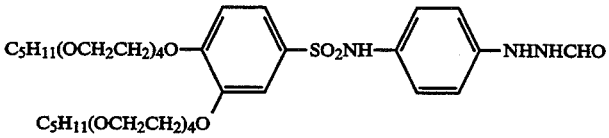

The results of the tests will be given in the following Tables 1 and 2.

TABLE 1

| Sample No. | Compound [I]*1 | Nucleation*2 accelerator | Dot quality | Black spot |
|---|---|---|---|---|
| 1 (Inv.) | I-3 | B-6 | 4 | 4 |
| 2 (Inv.) | I-32 | B-1 | 5 | 4 |
| 3 (Inv.) | I-33 | B-2 | 5 | 4 |
| 4 (Inv.) | I-37 | B-2 | 5 | 5 |
| 5 (Inv.) | I-44 | B-6 | 4 | 5 |
| 6 (Inv.) | I-45 | B-2 | 4 | 5 |
| 7 (Inv.) | I-46 | B-2 | 5 | 4 |
| 8 (Inv.) | I-47 | B-2 | 5 | 5 |
| 9 (Inv.) | I-49 | B-6 | 5 | 4 |
| 10 (Inv.) | I-50 | B-2 | 5 | 5 |
| 11 (Inv.) | I-61 | B-1 | 5 | 4 |
| 12 (Inv.) | I-68 | B-2 | 4 | 4 |
| 13 (Inv.) | I-94 | B-2 | 5 | 4 |
| 14 (Comp.) | C-1 | B-1 | 3 | 2 |
| 15 (Comp.) | C-2 | B-2 | 3 | 2 |
| 16 (Comp.) | C-3 | B-1 | 3 | 2 |

*1Addition amount; $5 \times 10^{-4}$ mol/mol Ag
*2Addition amount; $2 \times 10^{-3}$ mol/mol Ag As is clear from the table, samples Nos. 1 to 13 of the present invention ranked "4" or more in terms of dot quality, but comparative sample Nos. 14 to 16 ranking "3" were inferior.

As for black dot, samples of the invention ranked either "5" or "4", indicating their excellent quality in terms of fog. In contrast, comparative samples each ranked "2" and hence were not satisfactory in terms of fog.

Example 2

Samples 17 to 26 were prepared in the same manner as in Example 1, except that the monodispersity of silver halide grains contained in sample Nos. 4 and 10 was changed to values between 4 to 40.

During the preparation of silver halide grains, rhodium and iridium were incorporated in the usual manner in respective amounts of $8\times10^{-7}$ mol and $3\times10^{-7}$ mol per of Ag. The silver halide grains thus prepared were AgBrCl grains having 98 mol % chloride. In place of spectral sensitizing dyes (a) to (e), a desensitizing dye (f) having the following structure was added.

The following filter dye-3 and UV absorber-4 were also added to the protective layer in an amount of 50 and 100 mg/m$^2$, respectively.

Desensitizing dye (f)

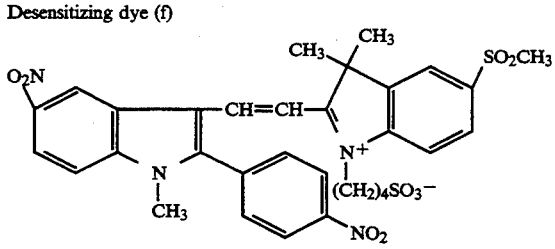

(a positive sum of the anode and cathode potentials on polarograph)

Dye-3

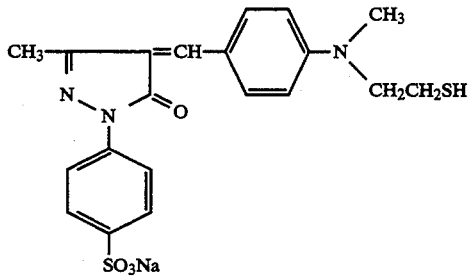

(λmax of absorption in water: 492 nm)

Dye-4

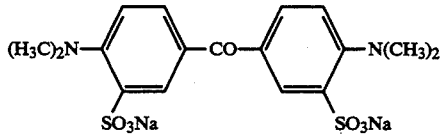

The other features of sample Nos 17 to 26 were the same as sample Nos. 4 and 10; for example, they used compounds I-37 and i-50 as a compound of Formula (I). The monodispersity of silver halide grains were adjusted by a conventional controlled double-jet method with pH and the supply of Ag and halide ions being varied during the process of preparing grains.

Samples were subjected to exposure and processing and evaluated in the same manner as in Example 1, except that exposure was conducted under an ultrahigh-pressure mercury lamp at an energy of 5 mJ.

The results thereof are shown in Table 2. As can be seen from the table, sample Nos 17 to 26 ranked 4.5 to 5 in terms of both dot quality and black dot. Hence, those samples of the invention had very high dot quality and very small fog.

TABLE 2

| Sample No. | Compound [I] | Monodispersity of emulsion | Dot quality | Black dot |
|---|---|---|---|---|
| 17 (Inv.) | I-37 | 40 | 4.5 | 4.5 |
| 18 (Inv.) | I-37 | 35 | 4.7 | 4.7 |
| 19 (Inv.) | I-37 | 20 | 4.8 | 4.8 |
| 20 (Inv.) | I-37 | 10 | 5.0 | 5.0 |
| 21 (Inv.) | I-37 | 4 | 5.0 | 5.0 |
| 22 (Inv.) | I-50 | 40 | 4.5 | 4.5 |
| 23 (Inv.) | I-50 | 35 | 4.7 | 4.7 |
| 24 (Inv.) | I-50 | 20 | 4.7 | 4.8 |
| 25 (Inv.) | I-50 | 10 | 5.0 | 5.0 |
| 26 (Inv.) | I-50 | 4 | 5.0 | 5.0 |

Example 3

(Preparation of Emulsion A)

A monodispersed silver bromide emulsion was prepared in the following manner.

While an aqueous solution containing ossein gelatin was being kept at 70° C. and violently stirred, both of an aqueous silver nitrate solution and an aqueous potassium bromide solution were added thereto at the same time by a controlled double-jet precipitation method, so that an octahedral grain emulsion having an average grain size of 0.4 μm was obtained. To the resulting emulsion, 5 mg of sodium thiosulfate and 6 mg of chloroauric acid (tetrahydrate) were each added per mol of the silver content of the emulsion and the mixture thereof was chemically ripened by heating it at 75° C. for 80 minutes, so that a silver bromide core emulsion was obtained. The core emulsion was grown up by further adding an aqueous silver nitrate solution and an aqueous solution containing potassium bromide and sodium chloride (in a molar rate of 50:50), so that an octahedral, monodisperse, core/shell type silver chlorobromide emulsion could be obtained. After washing the emulsion, 1.3 mg of sodium thiosulfate and 1.3 mg of chloroauric acid (tetrahydrate) were added thereto per mol of the silver content of the emulsion and were then heated at 60° C. for 70 minutes. After subjecting a chemical sensitization treatment, an internal latent image type silver halide emulsion was prepared.

(Preparation of photographic samples)

A color photographic light sensitive material comprising a polyethylene-laminated paper support having thereon the following layer constitution was prepared. The resulting sample is called Sample 27, in which the amounts of each compound are indicated by the amounts coated and the units are indicated by mg/dm$^2$, unless otherwise stated; provided, the amounts of silver halide emulsions are indicated by converting them into the corresponding silver contents and the structures of the compounds will be given later.

| | |
|---|---|
| Layer 7 (a protective layer) | 12.3 |
| Gelatin | |
| Layer 6 (a UV absorption layer) | |
| Gelatin | 5.4 |
| UV absorbent (UV-1) | 1.0 |
| UV absorbent (UV-2) | 2.8 |
| Solvent (SO-3) | 1.2 |
| Layer 5 (a blue-sensitive layer) | |
| Emulsion A (containing sensitizing dye BD-1) | 5.0 |
| Gelatin | 13.5 |
| Yellow coupler (YC-1) | 8.4 |
| Image stabilizer (AO-3) | 3.0 |
| Solvent (SO-1) | 5.2 |
| Compound (d) | $5 \times 10^{-3}$ mols/mol of Ag |
| Layer 4 (a yellow filter layer) | |
| Gelatin | 4.2 |
| Yellow colloidal silver | 1.0 |
| UV absorbent (UV-1) | 0.5 |
| UV absorbent (UV-2) | 1.4 |
| Color-mixing inhibitor (AS-1) | 0.4 |
| Solvent (SO-3) | 0.8 |
| Layer 3 (a green-sensitive layer) | |
| Emulsion A (containing sensitizing dye GD-1) | 2.7 |
| Gelatin | 13.0 |
| Magenta coupler (MC-1) | 2.4 |
| Image stabilizer (AO-1) | 2.0 |
| Solvent (SO-4) | 3.15 |
| Compound (C-1) | $5 \times 10^{-3}$ mols/mol of Ag |
| Layer 2 (a color-mixing inhibition layer) | |

-continued

| | |
|---|---|
| Gelatin | 7.5 |
| Color-mixing inhibitor (AS-1) | 0.55 |
| Solvent (SO-2) | 0.72 |
| Layer 1 (a red-sensitive layer) | 4.0 |
| Emulsion A (containing sensitizing dyes RD-1 and RD-2) | |
| Gelatin | 13.8 |
| Cyan coupler (CC-1) | 2.1 |
| Cyan coupler (CC-2) | 2.1 |

-continued

| | |
|---|---|
| Image stabilizer (AO-3) | 2.2 |
| Solvent (SO-1) | 3.3 |
| Compound (C-1) | $5 \times 10^{-3}$ mols/mol of Ag |

In addition to the above, SA-1 and SA-2 were used as coating aids and HA-2 was used as a hardener, so that the layers were coated.

SO-1: Dibutylphthalate
SO-2: Dioctylphthalate
SO-3: Di-(3-methyl-5,5-dimethylpentyl)phthalate
SO-4: Di-i-decylphthalate
AS-1: Di-t-octylhydroquinone
SA-1: Sodium Di-(2-ethylhexyl)-sulfosuccinate
SA-2: Sodium Di-(2,2,3,3,4,4-octafluoropentyl)-sulfosuccinate
HA-1: 2,4-dichloro-6-hydroxy-s-triazine sodium salt

RD-1

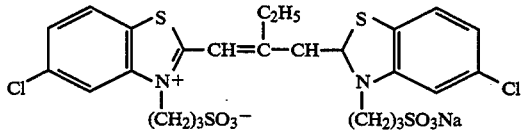

RD-2

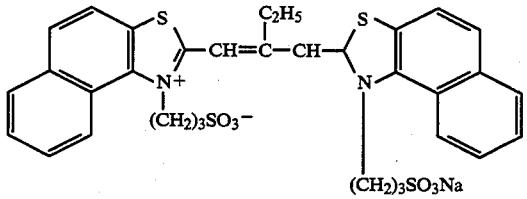

GD-1

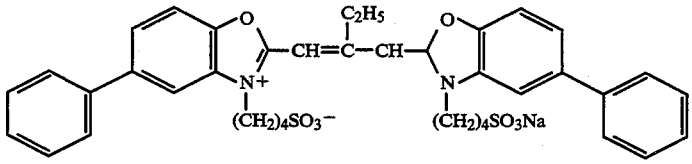

BD-1

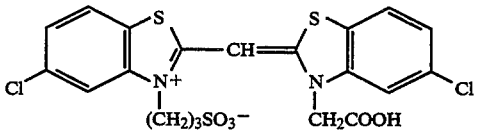

CC-1

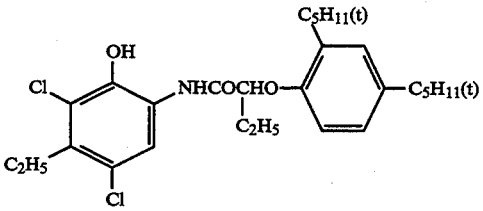

CC-2

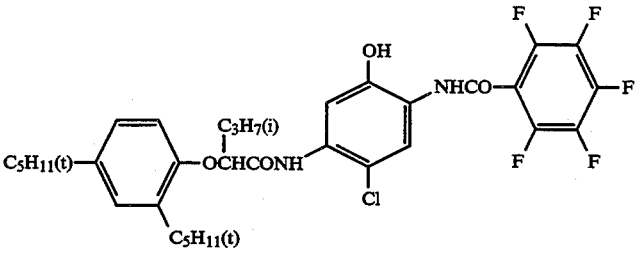

-continued

MC-1

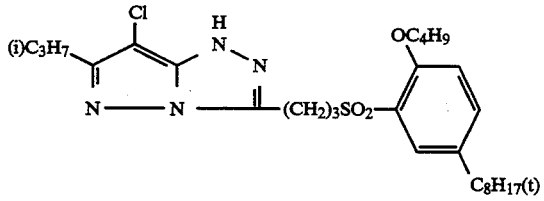

YC-1

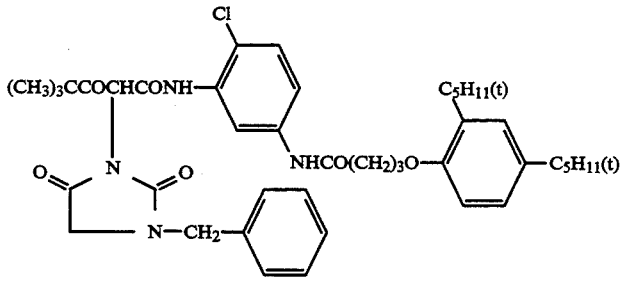

AO-1

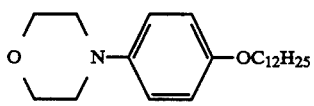

AO-3

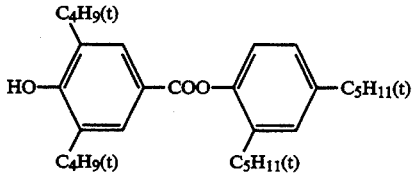

UV-1

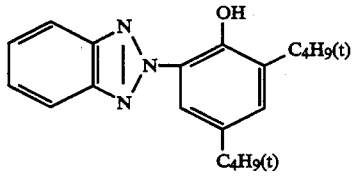

UV-2

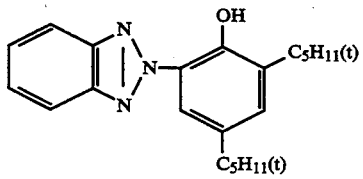

Additional sample Nos 28 to 44 were each prepared in the same manner as in Sample 27, except that Compound (C-1) of each layer of Sample 27 were replaced by Compounds (C-2), (C-3) and the foggants of the invention represented by Formula (I) shown in Table 3, respectively.

Each of the resulting samples was exposed to light through an optical wedge by making use of a photosensitometer and was then processed in the following processing steps.

(Process-1)

| Processing step | Time | Temperature |
|---|---|---|
| Color developing | 2 min. | 33° C. |
| Bleach-fixing | 40 sec. | 33° C. |
| Stabilizing | 20 sec × 3 times | 33° C. |
| Drying | 30 sec. | 60~80° C. |

Color developer-1

-continued (Process-1)

| | |
|---|---|
| Diethylenetriamine pentaacetic acid | 2.0 g |
| Benzyl alcohol | 12.8 g |
| Diethylene glycol | 3.4 g |
| Sodium sulfite | 2.0 g |
| Sodium bromide | 0.5 g |
| Hydroxylamine sulfuric acid | 2.6 g |
| Sodium chloride | 3.2 g |
| 3-methyl-4-amino-N-ethyl-N-(β-methanesulfonamidoethyl)aniline | 4.25 g |
| Potassium carbonate | 30.0 g |
| Fluorescent whitening agent (a 4,4'-diaminostilbene disulfonic acid derivative) | 1.0 g |
| Add water to make | 1 liter |
| Adjust pH (with potassium hydroxide and sulfuric acid) to be | 10.5 |

Bleach-fixer

| | |
|---|---|
| Ammonium thiosulfate (54% aq. soln.) | 150 ml |
| Sodium sulfite | 15 g |
| Iron (III) ethylenediaminetetraacetate | 55 g |

-continued

| (Process-1) | |
|---|---|
| Sodium ammonium ethylenediamine-tetraacetate (dihydrate) | 4 g |
| Glacial acetic acid | 8.61 g |
| Water to make | 1 liter |
| Adjust pH (with aqueous ammonia or hydrochloric acid) to be | 5.4 |
| **Stabilizer** | |
| 1-hydroxyethylidene-1,1'-diphosphonic acid (60% aq. soln.) | 1.6 ml |
| Bismuth chloride | 0.35 g |
| Polyvinyl pyrrolidone | 0.25 g |
| Aqueous ammonia | 2.5 ml |
| Trisodium nitrilotriacetate | 1.0 g |
| 5-chloro-2-methyl-4-isothiazoline-3-one | 50 mg |
| 2-octyl-4-isothiazoline-3-one | 50 mg |
| Fluorescent whitening agent (of the 4,4'-diaminostilbene type) | 1.0 g |
| Add water to make | 1 liter |
| Adjust pH (with potassium hydroxide or hydrochloric acid) to be | 7.5 |

This process is the same as Process-1, except that pH of the color developer was changed to be 11.0.

The resulting images were each subjected to sensitometry and the maximum density Dmax and the minimum density Dmin of the magenta images were evaluated. The results thereof are shown in Table 3 given below.

TABLE 3

| Sample No. | Compound [I] | Magenta image | Process-1 | Process-2 |
|---|---|---|---|---|
| 27 (Comp.) | C-1 | Dmax | 1.79 | 1.99 |
| | | Dmin | 0.17 | 0.19 |
| 28 (Comp.) | C-2 | Dmax | 1.74 | 1.94 |
| | | Dmin | 0.18 | 0.19 |
| 29 (Comp.) | C-3 | Dmax | 1.74 | 1.94 |
| | | Dmin | 0.18 | 0.19 |
| 30 (Inv.) | I-16 | Dmax | 2.03 | 2.24 |
| | | Dmin | 0.12 | 0.14 |
| 31 (Inv.) | I-25 | Dmax | 2.03 | 2.23 |
| | | Dmin | 0.12 | 0.15 |
| 32 (Inv.) | I-31 | Dmax | 2.05 | 2.25 |
| | | Dmin | 0.11 | 0.13 |
| 33 (Inv.) | I-55 | Dmax | 2.04 | 2.24 |
| | | Dmin | 0.11 | 0.13 |
| 34 (Inv.) | I-90 | Dmax | 2.04 | 2.25 |
| | | Dmin | 0.11 | 0.13 |

As is obvious from Table 3, it was proved that Samples 30 to 34 each containing the foggants of the invention can provide excellent positive images having a higher maximum density and a lower minimum density even when they are processed at a low pH, as compared to comparative Samples 27 to 29 each containing the comparative compounds which have been well-known as a foggant.

Example 4

Sample Nos 35 to 42 were each prepared in the same manner as in Example 3, except that the foggant was replaced by a compound shown in Table 4.

The resulting samples were exposed to light in the same manner as in Example 3 and were then processed in Process-1. The minimum density of each of the resulting magenta images was named Dmin.

On the other hand, a fresh sample (that was unexposed and undeveloped) was preserved for 3 days under the conditions of 50° C. and 80% RH so as to be thermostatically aged and, after that, it was exposed to light and processed in the same manner as mentioned before. The minimum density of the resulting magenta image was denoted as "D'min.".

Dmin and D'min values are shown in Table 4 given below.

TABLE 4

| Sample No. | Compound | Dmin | D'min |
|---|---|---|---|
| 35 (Comp.) | C-1 | 0.16 | 0.25 |
| 36 (Comp.) | C-2 | 0.18 | 0.30 |
| 37 (Comp.) | C-3 | 0.18 | 0.30 |
| 38 (Inv.) | I-19 | 0.12 | 0.16 |
| 39 (Inv.) | I-20 | 0.11 | 0.15 |
| 40 (Inv.) | I-21 | 0.11 | 0.15 |
| 41 (Inv.) | I-38 | 0.10 | 0.14 |
| 42 (Inv.) | I-76 | 0.12 | 0.16 |

As can be seen from Table 4, it is proved that Samples 38 to 42 containing the foggants of the invention were few in a minimum density increase, even after aging and excellent in aging stability, as compared to Samples 35 to 37 containing the comparative compound that is a well known foggant.

Example 5

A silver bromochloride emulsion containing a chloride a content of 70 mol % was prepared by mixing a solution of silver nitrate and a solution of NaCl and KBr by a controlled double jet method at a temperature of 36° C., pAg of 7.8 and pH of 3.0. During the formation of silver halide grains, $Na_2RhCl_6$ of $2\times10^{-7}$ mol per mol of silver was added thereto. The emulsion was desalted by adding a gelatin modified with phenyl isocyanate and then redispered in ossein gelatin solution containing fungicide [A], [B] and [C]. The emulsion comprised cubic crystal grains having an average size of 0.2 μm and a variation coefficient of 10%. Thus prepared emulsion was further subjected to chemical ripening over a period of 80 min. at 60° C. under the condition of pH of 5.8 and pAg of 7.5 by adding a compound S-1 (30 mg/mol Ag), 4-methyl-6-hydroxy-1,3,3a,7-tetrazaindene (60 mg/mol Ag), chloroauric acid (5 mg/mol Ag) and elemental sulfur (0.5 mg/mol Ag). After completing chemical ripening, 4-methyl-6-hydroxy-1,3,3a,7-tetrazaindene (900 mg/mol Ag), KI (300 mg/molAg) and a compound S-2 (350 mg/molAg) were further added thereto.

(Preparation a silver halide photographic material)

On one of the 0.1 μm-thick subbed layers on both sides of a 100 μm-thick polyethyleneterephthalate film, a silver halide emulsion layer having the following formula (1) was so coated as to have a gelatin content of 2.6 g/m² and a silver content of 3.2 g/m² and a protective layer having the following formula (2) was then so coated thereon as to have a gelatin content of 1.0 g/m². Further, on another subbed layer on the opposite side of the film, a backing layer having the following chemical formula (3) was so coated as to have a gelatin content of 3.1 g/m² and a backing protective layer having the following formula (4) was so coated thereon as to have a gelatin content of 1.0 g/m². Thus prepared fresh samples were aged for seven days under the condition of 60° C. and RH 75%.

| Formula 1 (Composition of silver halide emulsion layer) | |
|---|---|
| Gelatin | 2.6 g/m² |
| Silver halide emulsion | 3.2 g/m² |
| Adenin | 25 mg/m² |
| 1-Pheny-5-mercaptotetrazole | 2 mg/m² |
| 5-Nitroindazole | 10 mg/m² |

-continued

| Formula 1 (Composition of silver halide emulsion layer) | |
|---|---|
| Nucleating agent as show in Table 5 | $3 \times 10^{-5}$ mol/m$^2$ |
| Nucleation-accelerating agent as shown in Table 5 | $1 \times 10^{-4}$ mol/m$^2$ |
| Saponin | 0.1 g/m$^2$ |
| Sodium isopentyl-n-decyl-sulfosuccinate | 8 mg/m$^2$ |

-continued

| Formula 1 (Composition of silver halide emulsion layer) | |
|---|---|
| Polymer latex 1 | 1.0 g/m$^2$ |
| Water-soluble polymer A | 100 mg/m$^2$ |
| Colloidal silica | 0.5 g/m$^2$ |
| Compound K | 45 mg/m$^2$ |
| 2-Hydroxy-4,6-dichloro-1,3,5-triazine | 60 mg/m$^2$ |

| Formula (2) (Composition of the protective layer) | |
|---|---|
| Gelatin | 1.0 g/m$^2$ |
| Matting agent, Silica having an average size of 3.5 μm | 20 mg/m$^2$ |
| Polymer latex 2 | 0.5 g/m$^2$ |
| Sodium di-(2-ethylhexyl)-sulfosuccinate | 10 mg/m$^2$ |
| Surfactant F-1 | 2 mg/m$^2$ |
| Hydroquinone | 50 mg/m$^2$ |
| 1-Phenyl-4-hydroxymethyl-4'-methyl-3-pyrazolidone | 5 mg/m$^2$ |
| Formalin | 30 mg/m$^2$ |

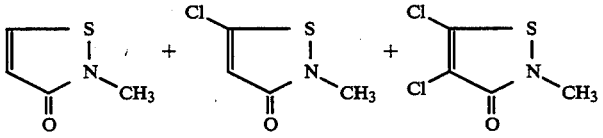

[A] + [B] + [C]

[A]:[B]:[C] = 46:50:4 (molar ratio)

S-1

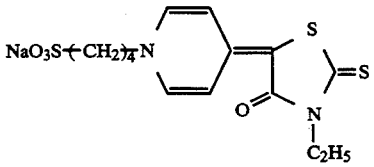

S-2

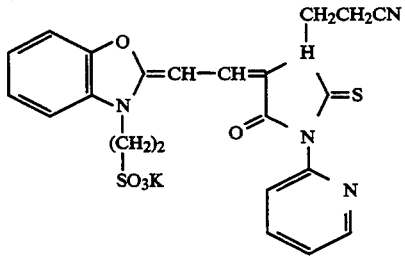

Compound K

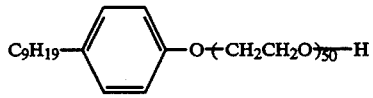

Polymer latex 1

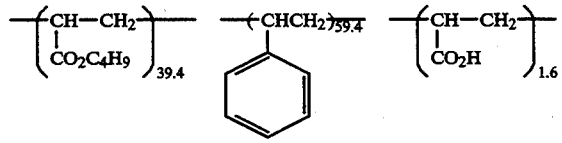

Polymer latex 2

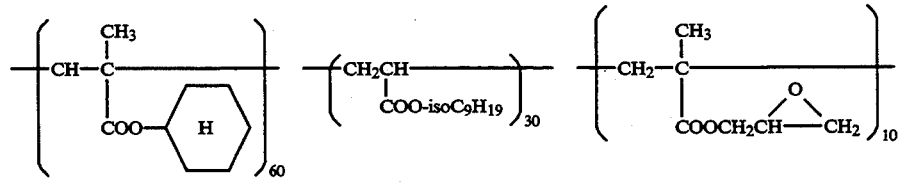

-continued

Formula (2) (Composition of the protective layer)

Water-soluble Polymer A

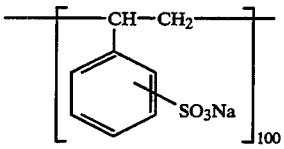

Surfactant F-1

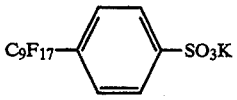

Formula (3) (Composition of backing layer)

Dye D-1 50 mg/m²

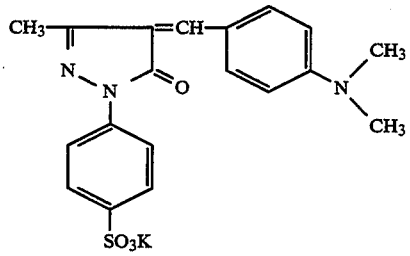

Dye D-2 40 mg/m²

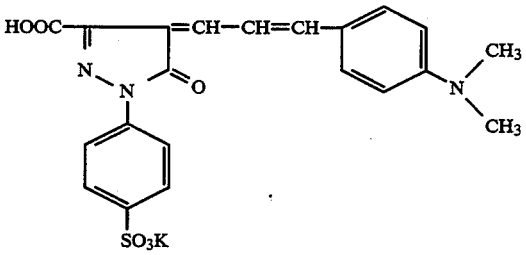

Dye D-3 30 mg/m²

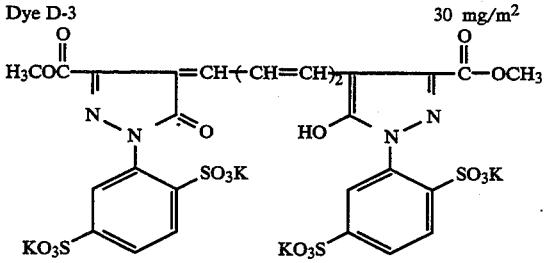

| | |
|---|---|
| Gelatin | 3.1 g/m² |
| Sodium dodecylbenzenesulfonate | 50 mg/m² |

Formula (4) (composion of backing protective layer)

| | |
|---|---|
| Gelatin | 1 g/m² |
| Polymethymetaacrylate (av. size, 4.0 μm) | 50 mg/m² |
| Sodium di-(2-ethylhexyl)-sulfo-succinate | 10 mg/m² |
| Glyoxal | 25 mg/m² |
| 2-Hydroxy-4,6-dichloro-1,3,5-triazine | 35 mg/m² |

(Enlargement of screen image)

(i) Preparation of halftone original

Using a scanner (SG-747, product by Dainihon Screen Co., Ltd.) and a scanner film (Konica New RST system RSP-3), a transparent halftone dot image and a step-wedged screen image of which dot percentage was gradually varied were prepared, wherein a screen frequency was 150 lines per inch.

(ii) Photographing

The above original was photographed using Fine Zoom C-880F (product by Dainihon Screen Co., Ltd.) so that enlargement ratio of screen image was set to be 120%. Exposure was controlled so that 95% of original stepwedge led to 5% image with respect to dot percentage. Exposed samples was subjected to processing.

(iii) Evaluation method

The dots in the halftone image of the processed sample were examined with respect to tone reproduction (blocking of the dots), wherein the samples were exposed so as to have an identical dot percentage in the small dot portion. The results were evaluated by five-graded criteria such as 5; excellent, 3; fair (limit of practical use) and 1; poor.

Using the following developer and fixer, samples were processed with a rapid processor.

| | |
|---|---|
| <Developer> | |
| Sodium sulfite | 50 g |
| 1-Phenyl-4-hydoymethyl-4-methyl-pyrazolidone | 0.85 g |
| Diethyltriaminepentaacetic acid | 1.5 g |
| Boric acid | 8 g |
| Potassium bromide | 4 g |
| Potassium carbonate | 55 g |
| 5-Methylbenzotriazole | 200 mg |
| Benzotriazole | 83 mg |
| Hydroquinone | 20 g |
| Potassium hydroxide, an amount necessary to make pH of 10.3 | |
| Water to make | 1 l |
| <Fixer> | |
| Ammonium thiosulfate (59.5% w/v aq. soln.) | 830 ml |
| Ethylenediaminetetraacetic acid | 515 mg |
| Sodium sulfite | 63 g |
| Boric acid | 22.5 g |
| Acetic acid (90% w/v aq. soln.) | 82 g |
| Citric acid (50% w/v aq. soln.) | 15.7 g |
| Gluconic acid (50% w/v aq. soln.) | 8.55 g |
| Aluminium sulfate (48% aq. soln.) | 13 ml |
| Glutaraldehyde | 3 g |
| Sulfuric acid to make pH of 4.6 | |
| Water to make | 1 l |

(Processing condition)

| Step | Temperature | Time |
|---|---|---|
| Developing | 38° C. | 30 sec. |
| Fixing | 33° C. | 20 sec. |
| Washing | — | 15 sec. |

With respect to black spot, evaluation was madw in the same manner as in Example 1. Results are shown in Table 5 as below. As can be seen therefrom, inventive samples are shown to be superior in dot reproduction such as black dot and dot enlargement to comparative samples, even after aged.

TABLE 5

| | Nucleating agent | Nuclear accelerating agent | Fresh sample | | Aged sample | |
|---|---|---|---|---|---|---|
| | | | Black spot | Dot-enlargement | Black spot | Dot-enlargement |
| 43 (Inv.) | I-37 | B-2 | 5 | 5 | 5 | 4 |
| 44 (Inv.) | I-50 | B-2 | 5 | 5 | 5 | 4 |
| 45 (Inv.) | I-98 | B-2 | 5 | 4 | 4 | 4 |
| 46 (Inv.) | I-103 | B-2 | 5 | 4 | 4 | 4 |
| 47 (Inv.) | I-105 | B-2 | 4 | 5 | 4 | 4 |
| 48 (Inv.) | I-106 | B-2 | 4 | 5 | 4 | 4 |
| 49 (Inv.) | I-109 | B-2 | 4 | 5 | 4 | 4 |
| 50 (Inv.) | I-111 | B-2 | 5 | 5 | 5 | 4 |
| 51 (Inv.) | I-112 | B-2 | 5 | 5 | 5 | 4 |
| 52 (Inv.) | I-114 | B-2 | 5 | 4 | 4 | 4 |
| 53 (Comp.) | C-1 | B-1 | 4 | 3 | 2 | 2 |
| 54 (Comp.) | C-2 | B-2 | 3 | 2 | 2 | 1 |
| 55 (Comp.) | C-3 | B-1 | 3 | 2 | 2 | 1 |
| 56 (Comp.) | C-4* | B-2 | 4 | 4 | 3 | 2 |

*C-4 (compound disclosed in JP-A-3-25924/1991)

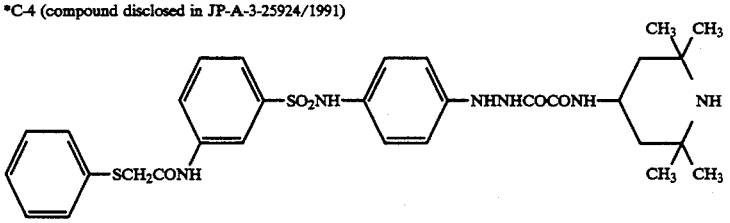

Example 6

Sample Nos 57 to 65 were each prepared in the same manner as in Example 4, except that the foggant was replaced by a compound shown in Table 6.

The resulting samples were exposed to light and then processed in the same manner as in Example 4. The minimum density of each of the resulting magenta images was denoted as Dmin.

On the other hand, fresh samples were preserved for 7 days under the conditions of 50° C. and 80% RH so as to be thermostatically aged and, thereafter, it was exposed to light and processed in the same manner as mentioned above. The minimum density of the resulting magenta image was denoted as D'min.

Dmin and D'min values are shown in Table 6 given below.

TABLE 6

| Sample No. | Compound | Dmin | D'min |
|---|---|---|---|
| 57 (Comp.) | C-1 | 0.16 | 0.31 |
| 58 (Comp.) | C-2 | 0.18 | 0.40 |
| 59 (Comp.) | C-3 | 0.18 | 0.40 |
| 60 (Comp.) | C-4 | 0.16 | 0.28 |
| 61 (Inv.) | I-50 | 0.15 | 0.15 |
| 62 (Inv.) | I-98 | 0.11 | 0.17 |
| 63 (Inv.) | I-105 | 0.11 | 0.17 |
| 64 (Inv.) | I-111 | 0.10 | 0.16 |
| 65 (Inv.) | I-112 | 0.10 | 0.16 |

As can be seen from Table 6, it is proved that Samples 61 to 65 containing the foggants of the invention were few in a minimum density increase, even after aging and excellent in aging stability, as compared to Samples 57 to 60 containing the comparative compounds that have been so far known as an foggant.

What is claimed is:

1. A silver halide photographic light sensitive material comprising a support having thereon a silver halide emulsion, wherein said silver halide photographic material contains a compound represented by the following formula (I):

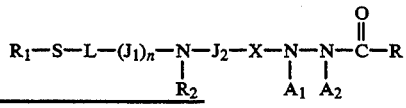

Formula (I)

wherein $R_1$ represents an alkyl group, an alkenyl group, an alkynyl group, an aryl group or a heterocyclic group; $R_2$ represents a hydrogen atom, an alkyl group, an aryl group or a heterocyclic group; R represents a hydrogen atom or a blocking group; L represents an alkylene group or an alkenylene group, provided that $R_1$—S—L group contains at least two cyclic groups, which may be bonded, directly or through an aliphatic linkage group, with each other; $J_1$ and $J_2$ each represent a linkage group; n is 0 or 1; X represents an aromatic or heterocyclic residue; $A_1$ and $A_2$ are each hydrogen atoms, or one of them is a hydrogen atom and the other one is an acyl group, a sulfonyl group or an oxalyl group.

2. The silver halide photographic material of claim 1, wherein said $R_1$—S—L group contains at least two cyclic groups selected from an aromatic carbocyclic group, an alicyclic group and a heterocyclic group.

3. The silver halide photographic material of claim 1, wherein $A_1$ and $A_2$ are each hydrogen atoms.

4. The silver halide photographic material of claim 1, which is a high contrast light sensitive material containing said compound of formula (I) as a contrast-increasing agent.

5. The silver halide photographic material of claim 4, wherein said compound is contained in an amount of $5\times10^{-7}$ to $5\times10^{-1}$ mol per mol of silver halide.

6. The silver halide photographic material of claim 4, wherein said high contrast light sensitive material further contains a nucleation-accelerating agent.

7. The silver halide photographic material of claim 1, which is a direct positive light sensitive material containing said compound of formula (I) as a foggant.

8. The silver halide photographic material of claim 7, wherein said compound is contained in an amount of $1\times10^{-5}$ to $1\times10^{-1}$ mol per mol of silver halide.

* * * * *